US012768228B1

(12) United States Patent
Zeng et al.

(10) Patent No.: US 12,768,228 B1
(45) Date of Patent: Oct. 20, 2026

(54) DOWNHOLE CONVEYANCE MANAGEMENT DURING A LINE SPOOLING OPERATION

(71) Applicant: Halliburton Energy Services, Inc., Houston, TX (US)

(72) Inventors: Jianqiang Zeng, Houston, TX (US); Ritesh Dharmendra Panchal, Houston, TX (US); Sudhir Gupta, Houston, TX (US); German Reynoso, Houston, TX (US); Joao Scudeler Vilela, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/278,345

(22) Filed: Jul. 23, 2025

(30) Foreign Application Priority Data

May 30, 2025 (SG) ..... 10202501428R

(51) Int. Cl.

| | |
|---|---|
| ***E21B 19/22*** | (2006.01) |
| ***E21B 7/04*** | (2006.01) |
| ***E21B 44/02*** | (2006.01) |
| ***E21B 47/04*** | (2012.01) |

(52) U.S. Cl.
CPC ..... *E21B 19/22* (2013.01); *E21B 7/046* (2013.01); *E21B 44/02* (2013.01); *E21B 47/04* (2013.01); *E21B 2200/20* (2020.05)

(58) Field of Classification Search
CPC ..... E21B 19/22; E21B 47/04; E21B 7/046; E21B 44/02; E21B 2200/20
See application file for complete search history.

(56) References Cited

U.S. PATENT DOCUMENTS 4,117,600 A * 10/1978 Guignard ..... G01B 7/26 33/735
7,586,313 B2 9/2009 Hernandez-Marti et al.
7,822,802 B2 * 10/2010 Chen ..... H04W 4/00 709/201
8,613,310 B2 * 12/2013 Denoix ..... E21B 33/072 166/77.2

(Continued)

FOREIGN PATENT DOCUMENTS

WO WO-2016060684 A1 * 4/2016 ..... E21B 47/007
WO WO-2025160066 A1 * 7/2025 ..... E21B 44/00

OTHER PUBLICATIONS

International Search Report & Written Opinion; PCT Application No. PCT/US2025/041755; mailed Feb. 27, 2026.

*Primary Examiner* — Daniel P Stephenson
(74) *Attorney, Agent, or Firm* — NOVAK DRUCE CARROLL LLP

(57) ABSTRACT

Aspects of the subject technology relate to systems, methods, and computer-readable media for maintaining a downhole conveyance. Specifically, a spooling operation of displacing line relative to a hole in a downhole environment, the line spooling operation comprising either or both a running in the hole (RIH) operation and a pulling out of the hole (POOH) operation can be performed. Further, information related to the line during the spooling operation as a function of wrap number relative to a drum that spools the line during the RIH operation and the POOH operation can be identified. As follows, the line can be controlled during the spooling operation based on the information.

19 Claims, 18 Drawing Sheets

(56) References Cited

U.S. PATENT DOCUMENTS

| | | | | |
|---|---|---|---|---|
| 2009/0013774 | A1 | 1/2009 | De Jesus et al. | |
| 2009/0127525 | A1* | 5/2009 | Teurlay | B66D 1/505 254/274 |
| 2010/0294479 | A1 | 11/2010 | Shee | |
| 2011/0006149 | A1 | 1/2011 | Baugh | |
| 2014/0199152 | A1* | 7/2014 | Roodenburg | B66D 1/7405 254/290 |
| 2016/0031685 | A1* | 2/2016 | Lawson | B66D 1/30 414/800 |
| 2016/0040523 | A1 | 2/2016 | Ives et al. | |
| 2016/0114862 | A1* | 4/2016 | Janik | B66D 1/505 254/362 |
| 2016/0215579 | A1 | 7/2016 | Van Der Ende | |
| 2016/0229672 | A1* | 8/2016 | Breard | E21B 19/02 |
| 2018/0051540 | A1 | 2/2018 | Castillo et al. | |
| 2018/0298746 | A1* | 10/2018 | Short | E21B 41/00 |
| 2022/0316316 | A1* | 10/2022 | Short | E21B 44/00 |
| 2024/0352811 | A1 | 10/2024 | Behrens et al. | |
| 2025/0354447 | A1* | 11/2025 | Panchal | E21B 23/14 |

* cited by examiner

DOWNHOLE CONVEYANCE MANAGEMENT DURING A LINE SPOOLING OPERATION

CROSS-REFERENCE TO RELATED APPLICATIONS

This application claims priority benefit to Singapore Provisional Application No. 10202501428R filed May 30, 2025, which is incorporated herein by reference.

TECHNICAL FIELD

The present disclosure generally relates to managing a downhole conveyance during a line spooling operation, and more specifically to managing a downhole conveyance during a line spooling operation based on information related to the line as a function of wrap number during the spooling operation.

INTRODUCTION

In wireline logging operations, a Z-chart can be used to monitor depth and line tension as the wireline moves in and out of the hole. Z-charts can be manual recording by the winch operator. Manually recording Z-charts can lead to human error, data loss, slow processing, and difficulty in data analysis.

BRIEF DESCRIPTION OF THE DRAWINGS

The various advantages and features of the present technology will become apparent by reference to specific implementations illustrated in the appended drawings. A person of ordinary skill in the art will understand that these drawings only show some examples of the present technology and would not limit the scope of the present technology to these examples. Furthermore, the skilled artisan will appreciate the principles of the present technology as described and explained with additional specificity and detail through the use of the accompanying drawings in which.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form to avoid obscuring the concepts of the subject technology.

As discussed previously, in wireline logging operations, a Z-chart can be used to monitor depth and line tension as the wireline moves in and out of the hole. Z-charts can be manual recording by the winch operator. Manually recording Z-charts can lead to human error, data loss, slow processing, and difficulty in data analysis.

The disclosed technology addresses the foregoing by identifying information related to a line during a spooling operation automatically, e.g. without manually recording by a winch operator. Specifically, the information related to the line can be a function of wrap number relative to a drum that spools the line during either or both a running in hole (RIH) operation and a pulling out of hole (POOH) operation. As follows, control of the line during the spooling operation can be facilitated based on the information. Specifically, the line can be automatically controlled based on the information. The information related to the line can also be a function of the layer number of the line spooled around the drum.

Figure 1A:
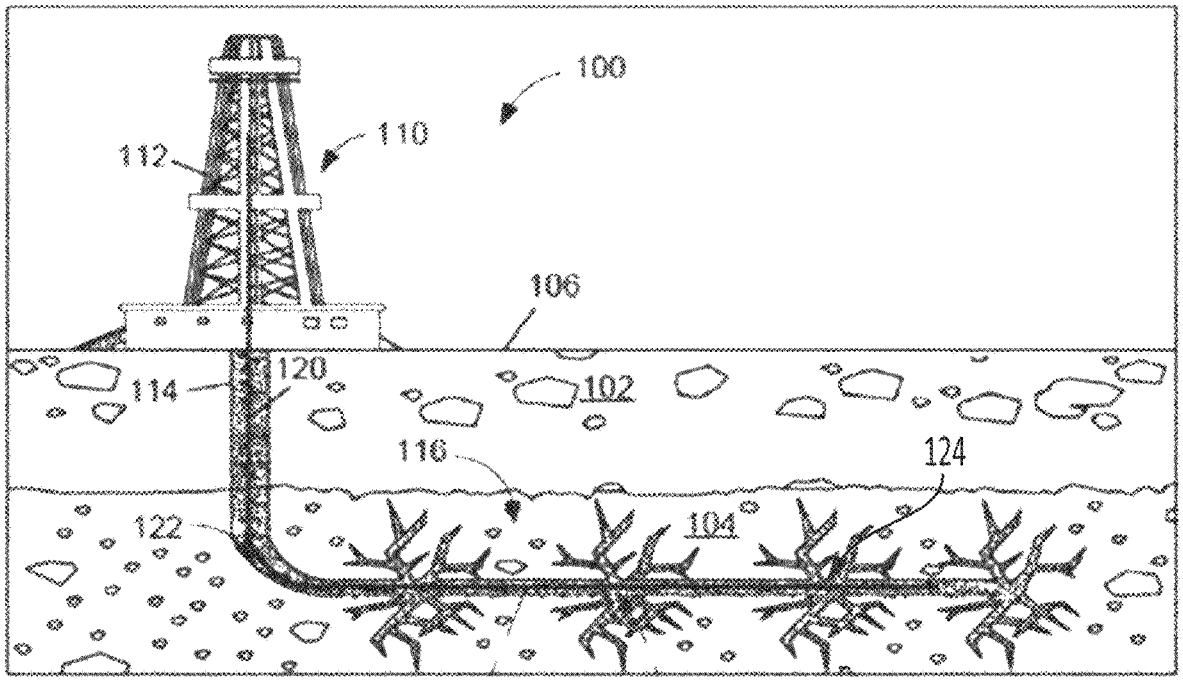
FIG. 1A illustrates a schematic diagram of an example wellbore operating environment, according to some examples of the present disclosure.

FIG. 1A illustrates a schematic diagram of an example wellbore operating environment 100. As depicted in FIG. 1A, the operating environment 100 includes a wellbore 114 that penetrates a formation 102 for the purpose of recovering hydrocarbons, storing hydrocarbons, injecting water or carbon dioxide, or the like in formation 104.

As depicted in FIG. 1A, formations 102 and 104 are subterranean formations, although it is noted that formations 102 and 104 may be subsea formations. In certain locations, there are a plurality of underground formations 102, 104. The wellbore 114 may extend substantially vertically away from the Earth's surface 106 over a vertical wellbore portion, or may deviate at any angle from the Earth's surface 106 over a deviated or horizontal wellbore portion 116. In alternative operating environments, portions or substantially all of the wellbore 114 may be vertical, deviated, horizontal, and/or curved. The wellbore 114 may be drilled into the formations 102, 104 using any suitable drilling technique. As shown, a drilling or servicing rig 110 disposed at the surface 106 (which may be the surface of the Earth, a seafloor surface, or a sea surface) comprises a derrick 112 from which a tubular string 120 (e.g., a drill string, a tool string, a segmented tubing string, a jointed tubing string, or any other suitable conveyance, or combinations thereof) is positioned within or partially within the wellbore 114. The tubular string 120 may include two or more concentrically positioned strings of pipe or tubing (e.g., a first work string may be positioned within a second work string). The drilling or servicing rig 110 may include a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. In such an environment, the tubular string 120 may be utilized in drilling, stimulating, completing, or otherwise servicing the wellbore, or combinations thereof. A drilling or servicing rig 110 may also comprise other equipment. In certain types of operations, a fluid 122 is forced down the tubular string 120 and out through perforations 124 to fracture the formations 104 that surround the perforations 124.

While FIG. 1A depicts a stationary drilling rig 110, one of ordinary skill in the art will readily appreciate that mobile workover rigs, stimulation units (such as fracturing pumps), wellbore servicing units (such as coiled tubing units), and the like may be employed. It is noted that while the figures or portions thereof may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. The horizontal, deviated, or vertical nature of any figure is not to be construed as limiting the wellbore to any particular configuration or formation.

Figure 1B:
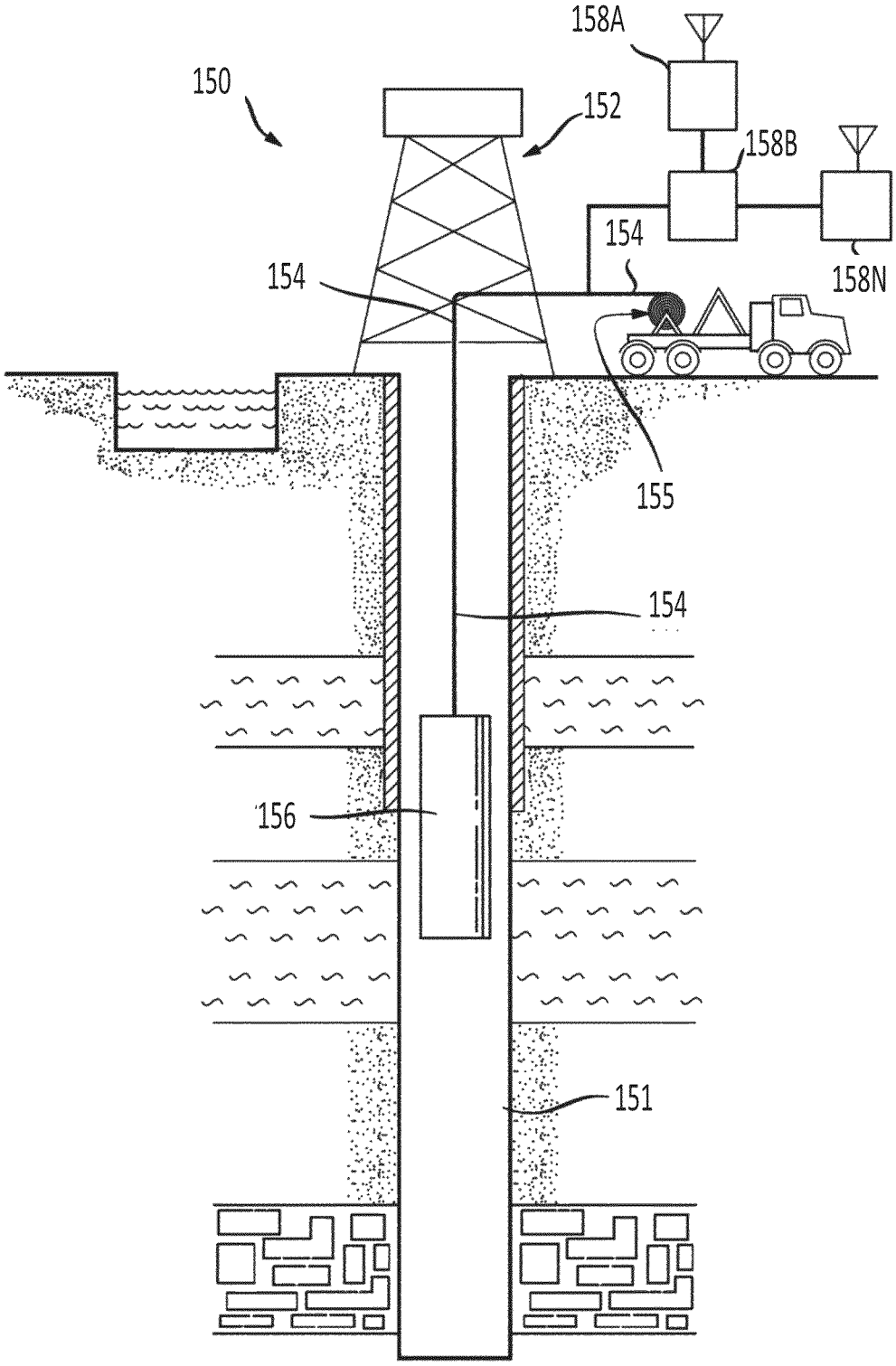
FIG. 1B illustrates an example system or conducting downhole measurements after at least a portion of a wellbore has been drilled and the drill string removed from the well, according to some examples of the present disclosure.

Referring to FIG. 1B, an example system 150 is depicted for conducting downhole measurements after at least a portion of a wellbore has been drilled and the drill string removed from the well. Various wireline tools can be operated in the example system 150 shown in FIG. 1B to log the wellbore. A downhole tool is shown having a tool body 156 in order to carry out logging and/or other operations. For example, instead of using a drill string to lower the downhole tool, which can contain sensors and/or other instrumentation for detecting and logging nearby characteristics and conditions of the wellbore 151 and surrounding formations, a wireline conveyance 154 can be used. Specifically, the tool body 156 can be lowered into the wellbore 151 by wireline conveyance 154. The wireline conveyance 154 can be anchored in the drill rig 152 or by a portable means such as a truck 155. The wireline conveyance 154 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 154 provides power and support for the tool, as well as enabling communication between data processors 158A-N on the surface. In some examples, the wireline conveyance 154 can include electrical and/or fiber optic cabling for carrying out communications. The wireline conveyance 154 is sufficiently strong and flexible to tether the tool body 156 through the wellbore 151, while also permitting communication through the wireline conveyance 154 to one or more of the processors 158A-N, which can include local and/or remote processors. The processors 158A-N can be integrated as part of an applicable computing system, such as the computing device architectures described herein. Moreover, power can be supplied via the wireline conveyance 154 to meet power requirements of the tool. For slickline or coiled tubing configurations, power can be supplied downhole with a battery or via a downhole generator.

Figure 2:
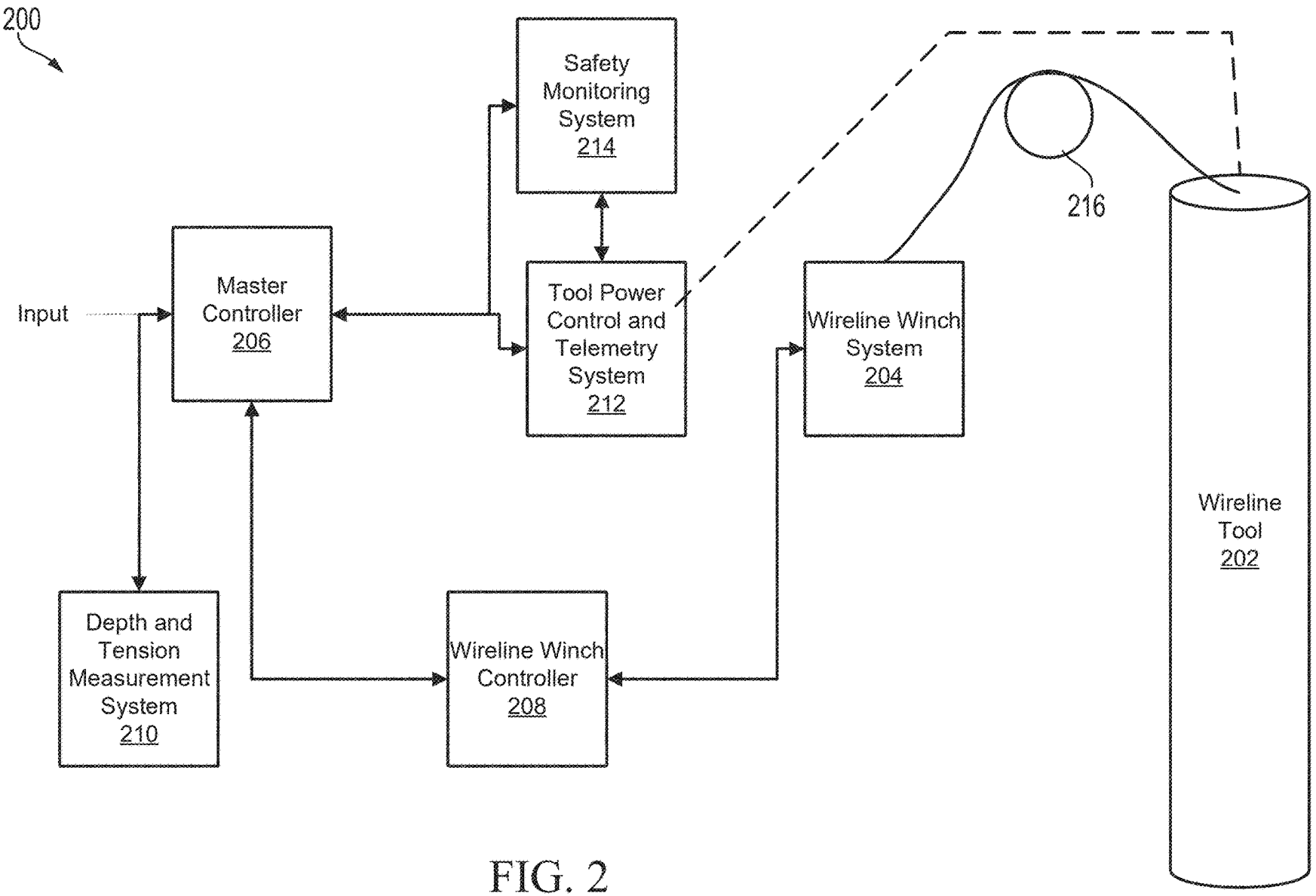
FIG. 2 illustrates a schematic diagram of a wireline system, according to some examples of the present disclosure.
Figure 3A:
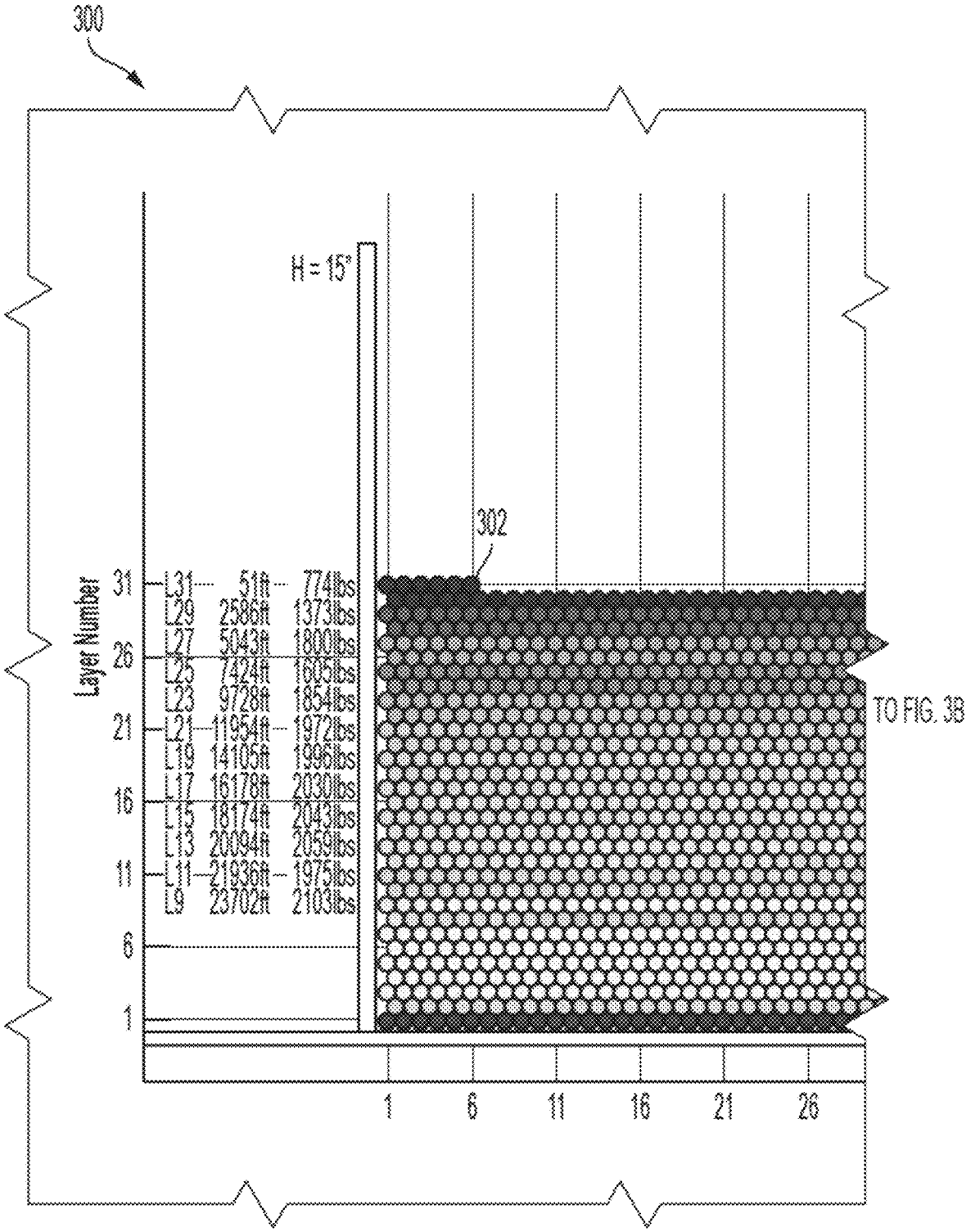
FIGS. 3A-D illustrate a graphical representation of the line information, according to some examples of the present disclosure.
Figure 3B:
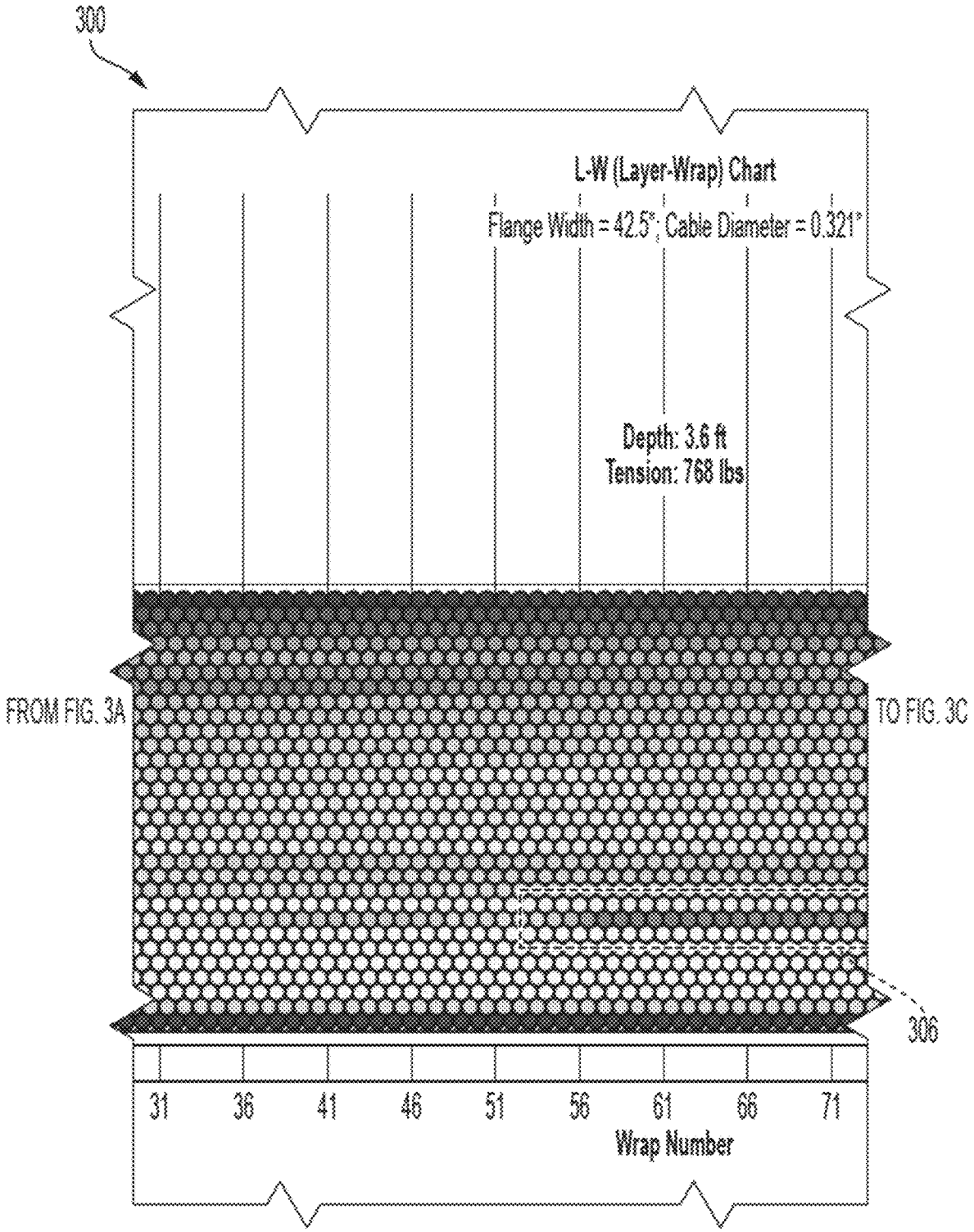
Figure 3C:
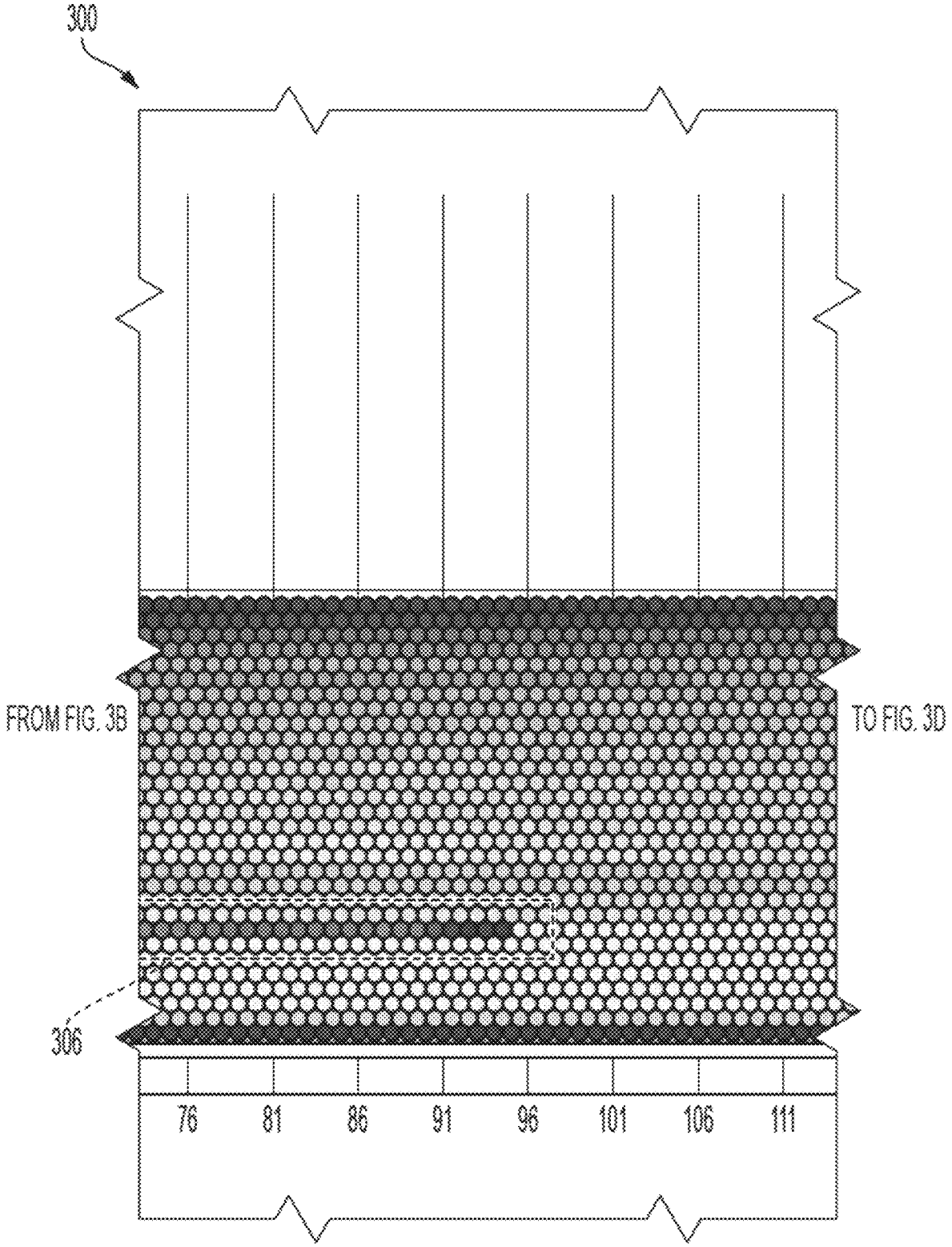
Figure 3D:
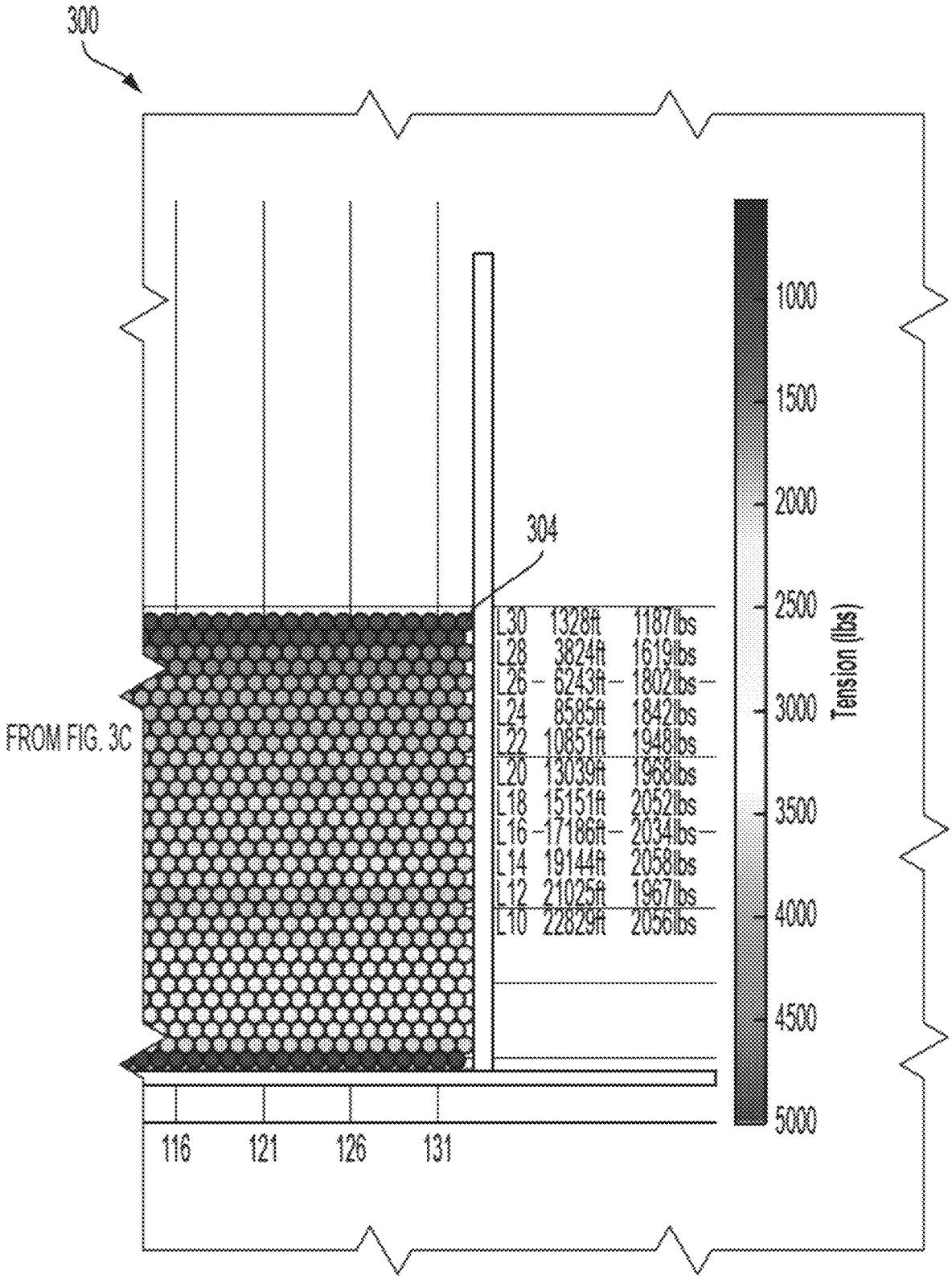

FIG. 2 illustrates a schematic diagram of a wireline system 200, according to some examples of the present disclosure. The wireline system 200 includes a wireline tool 202, a wireline winch system 204, a master controller 206, a wireline winch controller 208, a depth and tension measurement system 210, a tool power controller and telemetry system 212, and a safety monitoring system 214.

The wireline tool 202 is any applicable tool that can be disposed through a wireline for operation within a wellbore. Specifically, wireline tool 202 can include tools for wireline logging (formation evaluation/Reservoir monitoring/Well Integrity) or wireline well intervention services. The wireline tool 202 can power from the tool power control and telemetry system 212 and will have a communication link over wireline telemetry or some other applicable coupling with the tool power control and telemetry system 212. Tool operation commands (initiate/abort/hold/stop logging/intervention) can be transmitted from the tool power control and telemetry system 212. Such commands, as will be discussed in greater detail later, can be generated by the master controller 206. Specifically, such commands can be generated by the master controller 206 as part of autonomously controlling operation of the wireline system 200 based on gathered wireline information, e.g. based on a job plan implementing a service sequence of commands/operations. Log data, which includes applicable sensor data and status data that is generated and/or gathered by the wireline tool 202, can be transmitted from the tool processors to the tool power control and telemetry system 212 over the wireline telemetry.

The wireline winch system 204 functions to provide conveyance to the wireline tool 202 in operation in a wellbore. The wireline winch system 204 comprises a drive system for a drum. The drive system can be an electric motor driving a hydraulic pump or engine shaft driving the hydraulic pump. The wireline winch system 204 can also comprise a transmission between the drive system and the drum, a spooling guidance system for the wireline on the drum, a braking system for the drum, valves to provide mooring system, and a console with manual controls, e.g. a joystick for speed, switches for brake enable/disable. In providing conveyance to the wireline tool 202, the wireline winch system can control a tension of the line both at the wireline tool 202 and at the surface, a line speed change of the line in deploying the wireline tool 202 by controlling a speed power of the line. Further, the wireline winch system 204 can perform auto-spooling.

The wireline winch system 204 can communicate with the wireline winch controller 208 for controlling operation of the wireline winch system 204. Specifically, the wireline winch controller 208 can send commands to the wireline winch system 204 for controlling operation of the wireline winch system 204 itself. For example, the wireline winch controller 208 can send commands to the wireline winch system 204 for adjusting a power speed/winch speed of the line. Such commands for controlling the wireline winch system 204 can ultimately be generated by or caused to be generated by the master controller 206, as will be discussed in greater detail later, in an autonomous manner. The wireline winch system 204 can interface with a switch that allows for operation of the wireline winch system 204 through autonomous control or in a manual mode, e.g. through a joystick on the console by which a user can provide user inputs for the winch speed.

The master controller 206 functions to control operation of the wireline system 200. Specifically, the master controller 206 can control operation of the wireline system 200 in an autonomous manner. More specifically, the master controller 206 can control operation of the wireline system 200 based on wireline information associated with operation of the wireline system 200. In controlling operation of the wireline system 200, the master controller can control the wireline winch system 204, the power that is delivered to the wireline tool 202, and actual operation of the wireline tool 202. This control of the wireline tool 202 can be performed by the master controller 206 based on wireline information in an autonomous manner. Specifically, the master controller 206 can autonomously control the delivery of power to the wireline tool 202 based on wireline information.

Wireline information, as used herein, can include applicable information that is associated with operation of a wireline system in a wellbore. Specifically, wireline information can include information that is generated before actual operation of the wireline system. For example, wireline information can include a job/intervention plan for operating a wireline tool through a wireline system. The job/intervention plan can be developed and input to the controller 206 as part of user input. Further, wireline information can include information that is generated during actual operation of the wireline system. For example, wireline information can include wireline depth and tension measurements, wireline toll information, and safety issues/concerns detected during safety monitoring associated with operation of the wireline system. In various embodiments, wireline information can comprise tension of a line of the wireline system at a point at a surface of the wellsite, a depth of the wireline tool in the wellbore, a line speed change of the line of the wireline system in deploying the wireline tool in the wellbore, a downhole tension of the line in proximity to the wireline tool deployed in the wellbore, or a combination thereof, the method further comprising autonomously controlling the operation of the wireline system at the wellsite based on the tension of the line of the wireline system at a point at the surface of the wellsite, the depth of the wireline tool in the wellbore, the line speed change of the line of the wireline system in deploying the wireline tool in the wellbore, the downhole tension of the line in proximity to the wireline tool deployed in the wellbore, or a combination thereof.

In autonomously controlling operation of the wireline system 200, the master controller 206 can generate commands based on the wireline information. In turn, the master controller 206 can send those commands to appropriate controllers within the wireline system 200 or otherwise cause the wireline system 200 to operate according to the commands. The master controller 206 can generate the commands based on wireline information that is gathered during operation of the wireline system 200. For example, the master controller 206 can generate the commands based on a measured tension of a line of the wireline system at a point at a surface of the wellsite, a measured depth of the wireline tool in the wellbore, a measured line speed change of the line of the wireline system in deploying the wireline tool in the wellbore, a measured downhole tension of the line in proximity to the wireline tool deployed in the wellbore, or a combination thereof. Further, the master controller 206 can generate the commands based on user input for the job logging/intervention plan such as speed schedule for logging/conveyance, definition of the tools in the tool string, well survey, type of wireline cable, and other applicable user input.

In autonomously controlling operation of the wireline system, the master controller 206 can receive a job plan for operating the wireline system 200, e.g. as part of user input. The master controller 206 can then modify the job plan based on gathered wireline information, e.g. in runtime during operation of the wireline system 200. As follows, the master controller 206 can implement the modified job plan by generating commands for controlling the wireline system 200 according to the modified job plan.

The master controller 206 can comprise a logging and job sequence controller comprising a processing unit which is communicatively coupled to the tool power control and telemetry system 212, the depth and tension measurement system 210, and the winch controller 208. The controller can determine the expected tension on the cable based on limits defined in user input. The controller can also compute maximum and minimum tensions expected at various depths and compare these expected tension values with the limits defined by the user input. In turn, this can be used to autonomously send control commands to the wireline winch controller 208 for ultimately controlling operation of the wireline winch system 204. In controlling the wireline winch controller 208, the master controller 206 can send commands either in runtime or before the job.

The master controller 206 can send initiate, abort, stop, hold commands to the wireline winch controller 208. Further, the master controller 206 can send control signals to tool power supplies in the tool power control and telemetry system 212. For example, the master controller 206 can control tool power delivery through the tool power control and telemetry system 212. The master controller 206 can also receive information on runtime depth of the wireline tool 202 and tension on cable by the depth and tension measurement system 210. In turn this information, as part of wireline information, can be used to control operation of the wireline system 200. The master controller 206 can also communicate through a graphical user interface with a user for configuring the service, entering job plan/well survey, controlling runtime running of wireline tools, and display log data gathered by the wireline tool 202.

The master controller 206 can autonomously control operation of the wireline system 200 based on log data that is generated by the wireline tool 202, e.g. as part of controlling operation of the wireline system 200 based on wireline information. Specifically, the master controller 206 can interpret log data gathered by the wireline tool 202 and then autonomously control operation of the wireline system 200 based on the interpretation of the log data. For example, the master controller 206 can determine whether gathered log data is of a suitable quality, e.g. with respect to a threshold. As follows, the master controller 206 can cause the wireline system 200 to regenerate the log data if it determines that the gathered log data is not of a suitable quality.

The wireline winch controller 208 functions to control operation of the wireline winch system 204, e.g. based on commands received from the master controller 206. In various embodiments, the wireline winch controller 208 can take either runtime or depth vs speed schedule command from the master controller 206 and control the wireline winch system 204, e.g. in runtime. The wireline winch controller 208 can comprise a controller for a spooling system, a drive system for the wireline drum, winch brakes, transmission shifts (for slow/high speed control), mooring control, auto to manual & manual to auto mode transition and slow speed controls.

The wireline winch controller 208 can receive the job logging/intervention plan, speed schedule for logging/conveyance, definition of the tools in the tool string, well survey, type of wireline cable etc. from the master controller 206 and get initiate, stop and modify commands from the master controller 206 in runtime. The wireline winch controller 208 can receive the runtime depth and wireline tension measurements from the depth and tension measurement system 210. In turn, the wireline winch controller 208 can control the wireline winch system 204 based on such information.

The wireline winch controller 208 can control the wireline winch system 204 in either automatic or manual modes. In automatic mode, the desired winch speed command is built into speed scheduler from the master controller 206. The wireline winch controller 208 then controls the winch speed in runtime based on the speed schedule from the master controller 206, unless wireline tension at surface, is above or lower than limits communicated by the master controller 206. The wireline winch controller 208 can also control the wireline winch system 204 based on downhole tension, e.g. as measured by downhole tension sensors. In this case, the tool power control and telemetry system 212 can receive the runtime downhole tension measurement values over wireline telemetry and provide such measurement to the wireline winch controller 208.

Either or both the master controller 206 and the wireline winch controller 208 can operate to autonomously control the operation of the wireline system 200. Specifically, either or both the master controller 206 and the wireline winch controller 208 can operate to autonomously control a speed power of the line of the wireline system 200, a tension in the line of the wireline system 200, performance of auto-spooling, or a combination thereof. Such autonomous control can be achieved based on the previously described wireline information.

The depth and tension measurement system 210 functions to generate wireline information related to depth and tension measurements. Specifically, the depth and tension measurement system 210 can measure surface tension of the wireline and depth based on an encoder wheel 216 on the wireline. As follows, the wireline information generated by the depth and tension measurement system 210 can be sent to the master controller 206 and the wireline winch controller 208 for controlling/autonomously controlling the wireline system 200.

The tool power control and telemetry system 212 functions to generate wireline information related to components in proximity to and including the wireline tool 202. Specifically, the tool power control and telemetry system 212 houses communication hardware to send commands to the wireline tool 202 and receive data from sensors or the status of wireline tool controllers, e.g. through a telemetry connection. The tool power control and telemetry system 212 can also control provisioning of power to the wireline tool 202. For example, the tool power control and telemetry system 212 can provide more power to the wireline tool 202 when the wireline tool 202 is operating in a well intervention.

The safety monitoring system 214 functions to identify the occurrence of a safety concern in relation to operation of the wireline system 200. A safety concern, as used herein, includes an applicable event that occurs in relation to operation of the wireline system 200 and presents either an actual or a potential hazard to a human, a wellsite, or equipment at the wellsite. For example, a safety concern can include an intruder in the unsafe area near wireline, or wireline break. If a safety concern is detected, then the safety monitoring system 214 can present the concern to the master controller 206, e.g. as part of wireline information. As follows, the master controller 206 can control operation of the wireline system 200 based on the detected safety concern. For example, the master controller 206 can cause the wireline system 200 to perform an abort wireline operation, if an unsafe condition is detected by the safety monitoring system 214.

The safety monitoring system 214 can comprise a camera system and AI driven processor. Video stream from the camera system can be continuously analyzed to detect an unsafe operation. As follows an abort signal can be sent to either or both the master controller 206 and the wireline winch controller 208 to abort the operation by stopping the winch and applying brake.

All or applicable components of the wireline system 200 can have interfaces with edge devices that are accessible from a remote site. Specifically, the master controller 206 can be connected through a network to a remote user, otherwise connected at a remote site. In turn, a remote user can provide input for controlling operation of the wireline system 200 remotely, e.g. by remotely controlling operation of the master controller 206.

Wireline information, e.g. depth and tension measurements, made by the depth and tension measurement system 210 can be used in applying the technology described herein. Specifically, wireline information generated by the depth and tension measurement system 210 can be a function of wrap number related to a drum of the wireline system 200. For example, the wireline information can comprise tension as a function of wrap number. Further, the wireline information can be a function of a layer number of the line around the drum. For example, the wireline information can comprise depth of the line at every layer of the line wrapped around the drum.

The wireline system 200 can transmit/receive inputs, e.g. for identifying information related to the line during a spooling operation over Ethernet-OPC UA (Open Platform Communications Unified Architecture). A spooling operation, as used herein, can comprise an applicable operation associated with a spooled line around a drum. For example, a spooling operation can comprise a RIH operation or a POOH operation.

The depth and tension measurement system 210 can generate information related to a line during a spooling operation using an applicable input. For example, drum diameter, flange diameter, cable diameter, current radius, start and stop positions, wrap number, layer number, distance to cable, drum revolutions per minute (RPM), and drum position can all be used in generating the information related to the line during a spooling operation. Additionally, surface line tension and depth information can be received and used in generating, or otherwise be included as part of the line information. Depth and tension values can be automatically updated, and a graphical representation that can be used to visualizes tension at each wireline wrap and layer using different colors can be generated. By visualizing depth based on color, abnormal tension events can be shown in the graphical representation to alert an operator for quick corrective action. It also highlights potential faults during operation, allows for comparison of multiple runs with reference values, and provides a comparison against the tension profile during cable installation. Furthermore, the depth and tension measurement system 210 can retrieve depth references in the event of depth loss, ensuring accurate and reliable data throughout the operation.

The disclosure now continues with a discussion of graphical representations of line information. Specifically, FIGS. 3A-D illustrate a graphical representation 300 of the line information, according to some examples of the present disclosure. In the graphical representation 300, the tension measurement at each wrap position of the line spooled around the drum, e.g. wrap position 302, are represented by varying color or shade. Therefore, the graphical representation 300 represents the tension in the line of the line spooled around the drum. Further, the graphical representation 300 comprises depth measurements for the ends of each layer, e.g. layer 304, of line spooled around the drum.

Region 306 in the graphical representation has the lowest tension and represents when the tool was placed at the bottom of the hole and then lifted. In operation the information that is represented by the graphical representation 300 can be used in controlling the winch in performing the spooling operation, either in an automated manner, a semi-automated manner, or by an operator. Specifically, operation can be controlled to avoid drum crush. Drum crush occurs when the tension in the spooled line becomes too high and smashes or damages the line wrapped underneath it around the drum. In controlling operation, the speed of the winch can be controlled to reduce the drag, reduce the friction of the tool in the hole. Further, the speed of the winch can be controlled to ensure that the tension on the top wrapped layer does not exceed twice as much as the tension on a bottom or lower layer. By doing so, the risk of drum crush can be mitigated.

The graphical representation 300 can be updated in real-time to represent the information for the line as it is controlled during a spooling operation. Realtime, as used herein, can be defined as near instantaneous (e.g., consider sampling rates, etc.) and can include latency in communication (e.g., telemetry, etc.). For example, real-time can be instantaneous if communication between a controller and models are of zero latency. However, if the communication between a controller and models has as latency of 1 minute then real-time can be instantaneous plus 1 minute. In general, real-time means instantaneous plus latency or other system delay time. Other system delay time can include transmission time delay, acquisition time delay, processing time delay, or other system delays.

Figure 4:
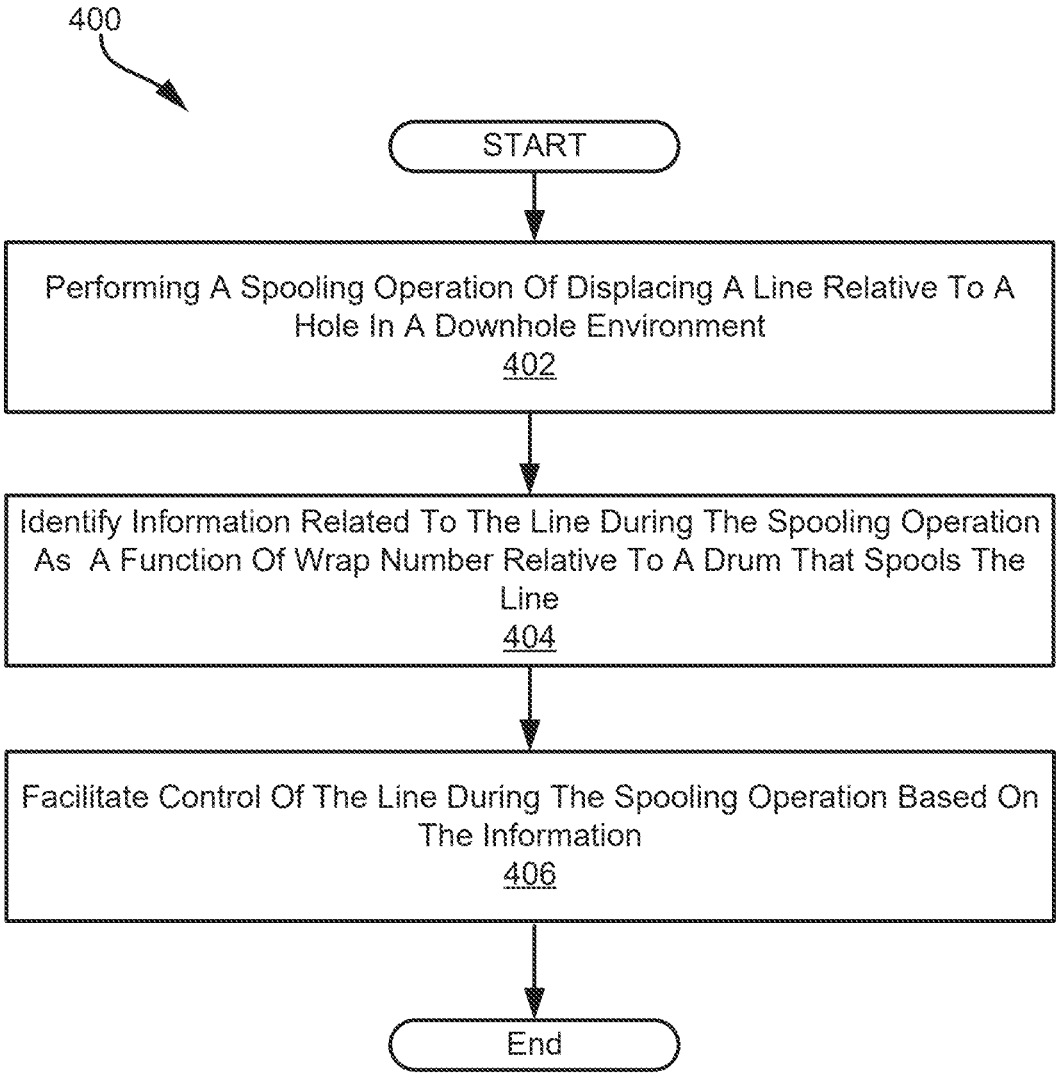
FIG. 4 illustrates a flowchart of an example method of identifying information of a line spooling around a drum and controlling a spooling operation based on the information, according to some examples of the present disclosure.

The disclosure now turns to a description of techniques for generating line information, controlling the line during a spooling operation based on the information. FIG. 4 illustrates a flowchart 400 of an example method of identifying information of a line spooling around a drum and controlling a spooling operation based on the information, according to some examples of the present disclosure. The method shown in FIG. 4 is provided by way of example, as there are a variety of ways to carry out the method. Additionally, while the example method is illustrated with a particular order of steps, those of ordinary skill in the art will appreciate that FIG. 4 and the modules shown therein can be executed in any order and can include fewer or more modules than illustrated. Each module shown in FIG. 4 represents one or more steps, processes, methods or routines in the method. The modules will be discussed with respect to the example environments described herein.

At module 402, a spooling operation of displacing a line relative to a hole in a downhole environment is performed. Specifically, a RIH operation or a POOH operation can be performed. The line can be wrapped around a drum or unwrapped from around the drum as part of the spooling operation.

At module 404, information related to the line during the spooling operation as a function of wrap number can be identified. Wrap number corresponds to the wrapping of the line around the drum. In various embodiments, the information can comprise a tension of the line at each wrap location as the line is spooled around the drum. Further, the information can be a function of a layer number of the line spooled around the drum. For example, the information can comprise depth information recorded at the end of each layer of the line spooled around the drum.

The information can include one or more derived parameters, e.g. parameters derived from tension and depth. Specifically, the information related to the line can comprise comprises predictive indicators of a probability of failure a system for performing the spooling operation, system wear of the system, degradation status of the system, remaining operational lifetime of the system, or a combination thereof. Further, the information can comprise abnormal tension events and potential faults associated with the line spooled around the drum. In various embodiments the information can be created across multiple spooling operations. In turn, multiple runs with reference values and retrieve depth references in the event of depth loss can be compared based on the information.

Applicable inputs can be used in generating the information at module 404. Specifically, surface tension measurements and depth measurements can be made through sensors at the surface. Specifically, direct measurement inputs like surface depth, line tension, drum RPM, drum position, cable diameter, cable eccentricity, along with geometric parameters such as drum diameter, flange diameter, current wrap number, and layer number can be used in generating the information. Furthermore, environmental parameters including downhole tension, downhole temperature, downhole pressure, and the weight of downhole equipment may also be used in generating the information. Integrating these varied data inputs supports robust analyses using physics-based modeling, machine learning, and predictive analytics, leading to enhanced monitoring, improved asset reliability, proactive maintenance planning, and comprehensive life-cycle management.

Further, sensing techniques such as electrical pulsing or electrical oscillations, monitoring reflections, attenuations, and echo responses to further assess and characterize line integrity. Similarly, acoustic pulsing or acoustic oscillation techniques can be utilized, wherein monitored reflections and attenuations provide supplementary insights into internal stresses, structural integrity, and associated stress effects. Also, optical based sensing techniques (imaging, polarimetric, spectroscopic, or vibrometric) can be used to assess corrosion, pitting, stresses, and line non-uniformities. These additional diagnostic approaches can serve to augment the information, enhancing the accuracy, sensitivity, and comprehensiveness of system monitoring, and providing a robust basis for predictive analytics and proactive asset management.

At module 406, control of the line during the spooling operation is facilitated based on the information. Specifically, the information can be used to control a system that displaces the line during the spooling operations, such as the wirelines system. More specifically, the information can be used to autonomously control displacement of the line during the spooling operation. In various embodiments, the information can be used to control subsequent spooling operations.

In automatically controlling a system for displacing the line based on the information, various automatic intervention actions can be performed based on the information. For example, automated actions can include slowing down, temporarily stopping, or reversing the spooling operation to mitigate immediate risks or abnormal conditions detected during operations. Additionally, real-time alerts detailing the nature and reason for these interventions can be generated. These alerts can be communicated locally to the winch operator, as well as remotely to offsite management, quality control personnel, or customers through secure software platforms or internet-based communication protocols, ensuring transparency and prompt corrective responses.

Specifically abnormal tension events and potential faults can be used in controlling operation of the spooling operation or future spooling operations. This can help to ensures that operators can quickly take corrective actions, thereby reducing the risk of human error and data loss. Further, when the operations are autonomously controlled, the control systems can factor in abnormal tensions events and potential faults in taking corrective actions. As discussed previously, the information associated with the line in the spooling operation can comprise predictive indicators such as probability of failure, system wear, degradation status, remaining operational lifetime, or composite indices that encapsulate multiple aspects of equipment integrity and condition. This information can be presented to an operator and used to control, e.g. autonomously, the system during a spooling operation. By presenting such enhanced analytics, the system can proactively inform maintenance decisions, asset management strategies, and operational adjustments, ultimately improving safety, reliability, and efficiency.

The disclosure now continues with a discussion of modeling and controlling spooling operations across different operations. Specifically, tension, and other information related to line displacement during a spooling operation, may be systematically tracked and recorded between operational jobs on the spool to identify segments of the conveyance material—such as wireline, coiled tubing, or similar equipment—that exhibit repeated or increasing tension levels. Advanced analytical techniques, including physics-based modeling and machine learning algorithms, can be employed to evaluate tension patterns across overlapping sections both within individual runs and between successive operations. These predictive analytics can highlight areas at elevated risk of imminent or future mechanical failure. A risk assessment using a design of service for an upcoming job can also be conducted and spools optimally assigned for expected upcoming use. By proactively identifying and addressing such risks, the operational lifespan of assets can be significantly extended, and the reliability and safety of subsequent runs markedly improved.

In scenarios where elevated tension or repeated abnormal tension profiles are identified across overlapping sections of cable, coiled tubing, or other conveyance equipment during multiple operational runs, appropriate remediation measures may be employed. For instance, field operators may perform a spool-down and subsequent spool-up procedure to alleviate and redistribute the tension along the affected segments, thus reducing stress concentrations and preventing equipment fatigue. Additionally, during shop maintenance, the conveyance equipment may undergo a comprehensive unwinding and rewinding procedure between a rewinding spool and the storage spool, allowing inspection, tension normalization, and repositioning to ensure optimal condition and reliability for future operations.

In facilitating control the operation based on the information, various levels of alarms can be generated based on the derived parameters and analytics described herein. These alarms may be communicated directly to the winch operator and/or routed through the quality control and quality assurance management chain. Notification recipients can include onsite personnel, offsite management, and customers, with alerts delivered via dedicated closed software systems or through remote internet-based protocols. Depending on the severity level of the alarm and other operational considerations, the system may suggest specific remediation actions, which can be executed either onsite or remotely, thus enabling rapid response to emerging issues and enhancing overall operational safety and reliability.

Figure 5:
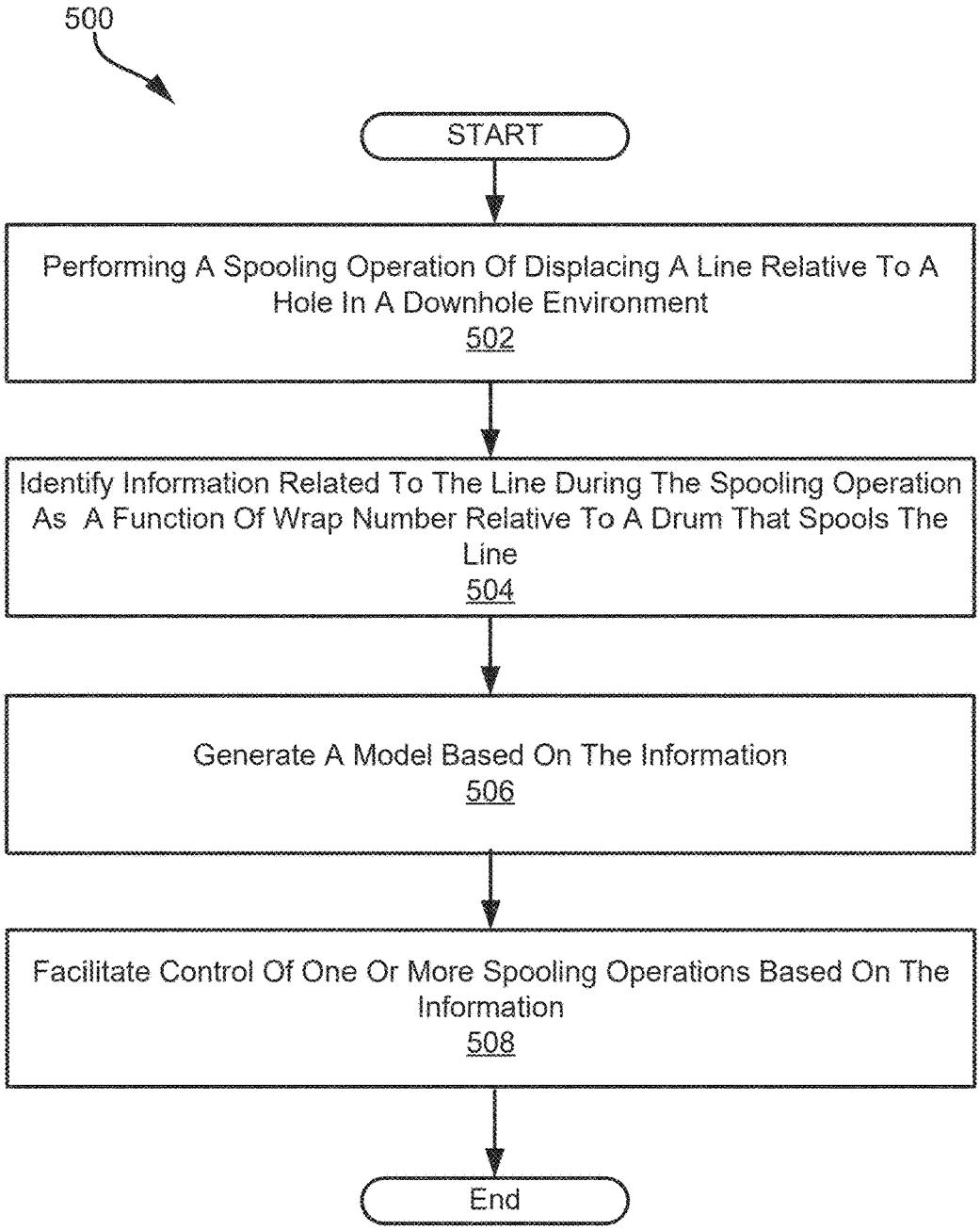
FIG. 5 illustrates a flowchart of an example method of modeling information related to line displacement during a spooling operation and controlling subsequent spooling operations, according to some examples of the present disclosure.

FIG. 5 illustrates a flowchart 500 of an example method of modeling information related to line displacement during a spooling operation and controlling subsequent spooling operations, according to some examples of the present disclosure. The method shown in FIG. 5 is provided by way of example, as there are a variety of ways to carry out the method. Additionally, while the example method is illustrated with a particular order of steps, those of ordinary skill in the art will appreciate that FIG. 5 and the modules shown therein can be executed in any order and can include fewer or more modules than illustrated. Each module shown in FIG. 5 represents one or more steps, processes, methods or routines in the method. The modules will be discussed with respect to the example environments described herein.

At module 502, a spooling operation of displacing a line relative to a hole in a downhole environment is performed. A spooling operation can comprise an applicable operation that involves displacement of a line into or out of a wellbore. While the technology has been described herein with respect to wireline technologies, it can be applied to an applicable environment where a line is moved into or out of a hole, e.g. as part of data acquisition or conveyance. Specifically, the technology can be applied to various other oilfield conveyance and spooling operations. This includes, but is not limited to, slickline, electric line (e-line), coiled tubing, coiled tubing remediation, coiled tubing evaluation operations, drilling operations, and other related applications involving surface-to-downhole, surface-to-surface, and downhole-to-downhole data acquisition and conveyance methods.

At module 504, information related to the line during the spooling operation is identified. More specifically, information related to the line during the spooling operations as a function of wrap number related to a drum that spools the line is identified. The information can be identified using the techniques described herein.

At module 506, a model is generated based on the information. The model can comprise an applicable model for representing information related to a line during a spooling operation and parameters for controlling the spooling operation. Specifically, the model can map line measurements to conditions and events related to the equipment for performing the spooling operation and the spooling operation itself. For example, the model can represent a relationship between spool RPM in relation to degradation of the line. The model can comprise an applicable machine learning or artificial intelligence model.

At module 508, control of one or more spooling operations is facilitated based on the information. The spooling operations can be subsequent spooling operations. Alternatively, the spooling operations can comprise a current spooling operation for which the information is generated at module 504.

In various embodiments the model can be applied to a plan of a subsequent spooling operation to perform a risk assessment, e.g. with respect to equipment, of the operation. In turn, the risk assessment can be analyzed and the subsequent spooling operation can be performed based on the risk assessment. Further, events can be predicted based on the model. As follows, the spooling operations can be controlled based on the predicted events.

In various embodiments, the technology described herein can be implemented in performing maintenance on equipment for performing a spooling operation. Specifically, the technology described herein may be integrated seamlessly with maintenance scheduling platforms, leveraging advanced system analytics to trigger predictive and proactive maintenance actions. Utilizing historical performance data, tension trends, derived stress indicators, and predictive analytics, the system can automatically identify optimal maintenance intervals and tasks, significantly reducing unplanned downtime. This integration ensures equipment health is maintained at peak operational levels, enhances asset longevity, and supports continuous operational reliability through timely and targeted interventions.

In various embodiments, the technology described herein can be integrated with digital twin technologies, enabling the creation of precise virtual replicas of spooling equipment and operations. These digital twins replicate real-time operational behavior, providing a powerful platform for advanced simulations, predictive diagnostics, scenario analysis, and operator training. By utilizing accurate, physics-based or machine-learning-driven digital representations, operators and engineers can simulate diverse operational conditions, identify potential issues before they occur, optimize equipment performance, and train personnel safely and effectively without risking actual equipment or operational downtime. This proactive approach greatly enhances reliability, safety, and overall efficiency.

In various embodiments, the technology described herein may also integrate seamlessly with asset tracking technologies such as RFID tagging and GPS tracking, enabling comprehensive logistics management, precise asset location tracking, and lifecycle monitoring. By embedding RFID tags or GPS trackers onto spooling assets like wireline reels, coiled tubing spools, or related equipment, operators can efficiently manage inventory, monitor asset utilization, track maintenance history, and analyze operational performance over time. This integrated approach streamlines asset management processes, enhances logistical efficiency, reduces operational costs, and ensures optimal asset deployment throughout the equipment lifecycle.

In various embodiments, the technology described herein can incorporate robust cybersecurity measures, utilizing industry-standard protocols and advanced encryption methodologies to secure data transmission, storage, and access control. Secure communication channels, encrypted using established encryption standards, ensure the confidentiality and integrity of operational data transmitted between system components and remote platforms. Furthermore, multi-layered access controls, including authentication and authorization mechanisms, protect against unauthorized data access, thus safeguarding sensitive operational information and ensuring compliance with industry cybersecurity standards and best practices.

In various embodiments, the technology described herein can incorporate real-time simulation capabilities specifically designed for comprehensive operator training and scenario preparedness. Leveraging historical operational data or hypothetical scenarios, the system provides realistic, dynamic simulations of various operational conditions and potential incidents. This enables operators to experience, anticipate, and effectively respond to complex or critical situations in a controlled, risk-free environment. By training with real-time, scenario-driven simulations, operators can enhance their proficiency, situational awareness, and decision-making skills, ultimately improving operational safety, reliability, and efficiency.

In various embodiments, the technology described herein can be augmented with advanced user interface technologies, such as augmented reality (AR) and virtual reality (VR), to significantly enhance data visualization, operational clarity, and situational awareness. These immersive visualization platforms provide operators with intuitive, interactive representations of real-time and historical operational data, facilitating quicker interpretation, improved decision-making, and proactive issue resolution. By incorporating AR or VR interfaces, operators can visualize complex relationships between tension profiles, operational parameters, and equipment health indicators, ultimately driving enhanced performance, safety, and overall operational efficiency.

In various embodiments, the technology described herein may include automated logging and reporting capabilities designed specifically to support regulatory compliance and adherence to industry operational standards. By systematically capturing, documenting, and securely storing detailed operational records—including depth, tension profiles, equipment status, and maintenance histories—the system ensures that accurate compliance data is consistently maintained. Automated reporting functions facilitate the generation of standardized compliance reports, simplifying audits, inspections, and regulatory submissions. This robust approach minimizes manual administrative effort, reduces compliance-related risk, and ensures ongoing alignment with industry guidelines and regulatory requirements.

In various embodiments, the technology described herein can support condition-based asset valuation by integrating detailed operational monitoring data into financial and risk management models. Real-time and historical data—including tension profiles, usage metrics, stress indicators, maintenance histories, and predictive analytics—can be used to precisely evaluate equipment condition, remaining service life, and asset reliability. By incorporating these condition-based insights into financial modeling and asset valuation processes, companies can achieve accurate, data-driven assessments of asset value, optimize investment strategies, mitigate operational risks, and make informed decisions regarding asset deployment, maintenance investments, and lifecycle management.

In various embodiments, the technology described herein can also incorporate environmental sustainability analysis by monitoring and recording critical metrics such as emissions, energy consumption, and other relevant environmental impact parameters associated with spooling and conveyance operations. These monitored environmental indicators can be integrated into sustainability tracking frameworks, allowing operators and management to assess and minimize environmental footprints actively. Utilizing real-time and historical sustainability data, the system supports informed decision-making, promotes operational practices that reduce environmental impact, and helps organizations achieve their sustainability and environmental stewardship objectives.

In various embodiments, the technology described herein can incorporate real-time operational efficiency metrics to facilitate ongoing performance evaluation, downtime analysis, and productivity optimization. By continuously capturing and analyzing key performance indicators such as operational speeds, tension profiles, spool utilization rates, equipment availability, and downtime events, the system provides actionable insights into efficiency trends and areas for improvement. Leveraging these analytics, operational teams can proactively identify bottlenecks, reduce unnecessary downtime, optimize equipment utilization, and enhance overall productivity and cost-effectiveness of operations.

In various embodiments, the technology described herein may feature extended integration capabilities through seamless interfaces with third-party software solutions, including Enterprise Resource Planning (ERP) systems, Asset Management Systems (AMS), and other operational software platforms. Such integrations enable automatic sharing and synchronization of critical operational data, asset condition metrics, maintenance schedules, and financial parameters across multiple systems and departments. By interfacing effectively with these platforms, the system promotes streamlined workflows, improved data consistency, enhanced decision-making, and comprehensive operational visibility, significantly increasing overall efficiency and reliability throughout the enterprise.

In some examples, it can be important to determine the wireline impedance while the downhole tool is powered up, deployed in the borehole with telemetry communicating with the surface equipment, performing motor operations downhole, and/or with the surface system running in a closed loop control to regulate downhole bus voltage. Conventional approaches can measure the wireline DC resistance, but can lack a AC component and transient characteristics. The measured DC resistance of the cable in runtime can be a critical parameter that can be used to adjust the downhole voltage to a desired set point. However, the lack of AC component in the DC resistance parameter can limit the control response time when reacting to dynamic changes in the downhole tool bus load.

Described below is a method to determine the parameter components that make up the wireline impedance in runtime and to use those parameters to set and regulate the downhole tool bus voltage. The ability to determine the wireline impedance parameters in runtime without powering off the downhole tools can be advantageous for tool operations because the wireline parameters can be continuously updated as the tool is deployed into the borehole. Furthermore, the proposed method can be used in system where the downhole bus voltage is regulated by the surface system or by a downhole DCDC converter. This can facilitate and improve the control accuracy and response time when regulating the downhole tool bus voltage for varying loads.

While the surface system is regulating the downhole bus voltage (in a closed loop manner, for example), it can sometimes be difficult to properly and accurately measure the wireline impedance while the downhole tool is deployed and operating in the borehole. In one example, in order to properly and accurately measure the wireline impedance, the disclosed system can continuously determine the wireline impedance as it unspools while the downhole tool is deployed in the borehole. In some examples, the downhole tool can be powered on and operate at varying loads. In this scenario, as the downhole tool is deployed, the wireline can continue to unspool, which can cause the cable impedance to change. The downhole bus voltage can be either controlled by the surface system to maintain regulation or include a downhole DCDC converter to perform regulation. The disclosed method can be used in either scenario. For example, in the scenario where the downhole bus voltage is controlled by the surface system, the surface voltage can change dynamically in response to the downhole load in order to maintain regulation for downhole bus voltage.

Figure 6:
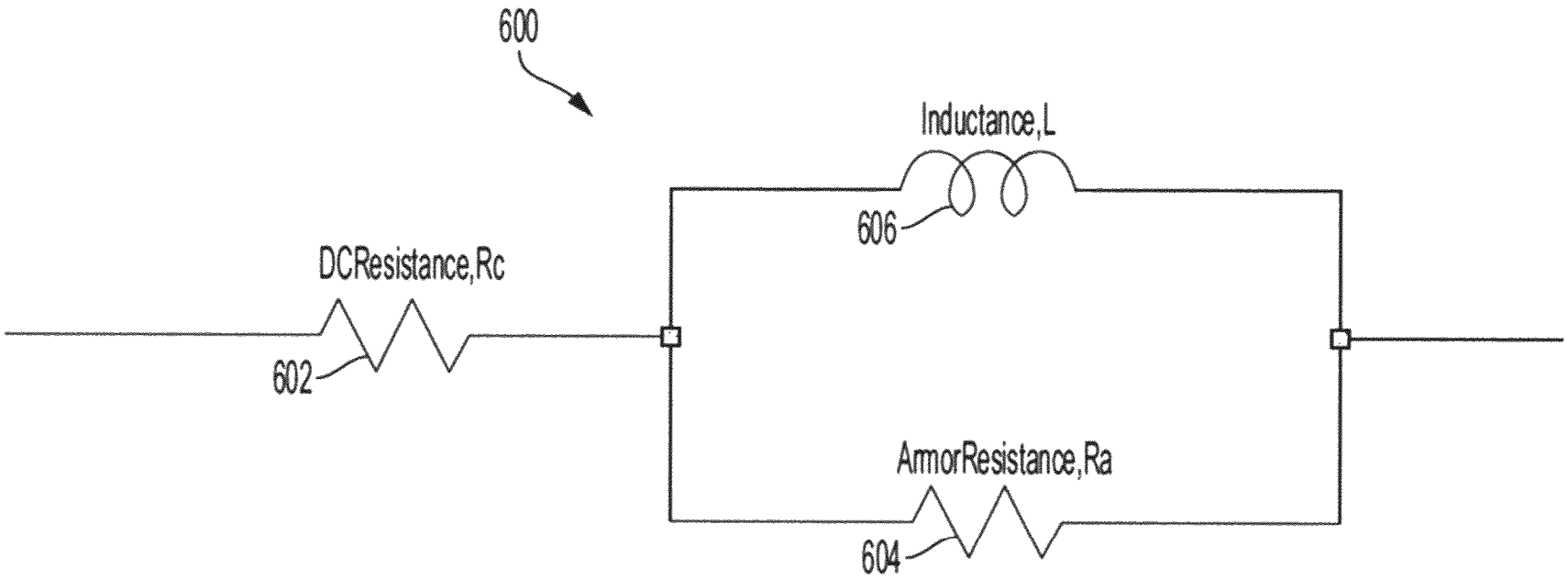
FIG. 6 illustrates an example low frequency wireline impedance model, according to some examples of the present disclosure.

In one example embodiment, the disclosed method can measure, compute and determine the wireline impedance comprising both DC and AC components. For example, the wireline impedance model 600 illustrated in FIG. 6 shows an example low frequency model, which can affect the downhole tool bus voltage regulation. As illustrated in FIG. 6, three example components can include a wireline DC resistance (Rc) 602, armor resistance (Ra) 604, and inductance (L) 606. Both the armor resistance 604 and inductance 606 can correspond to the AC component of the wireline impedance. Additionally, the armor resistance 604 can provide a discharge path for stored energy in the wireline to discharge through. In some examples, the DC component of the wireline can be determined during runtime and used as part of the plant model in the control loop. However, the lack of AC components can limit the control loop response time when responding to dynamic load changes at the downhole end of the wireline.

Figure 7:
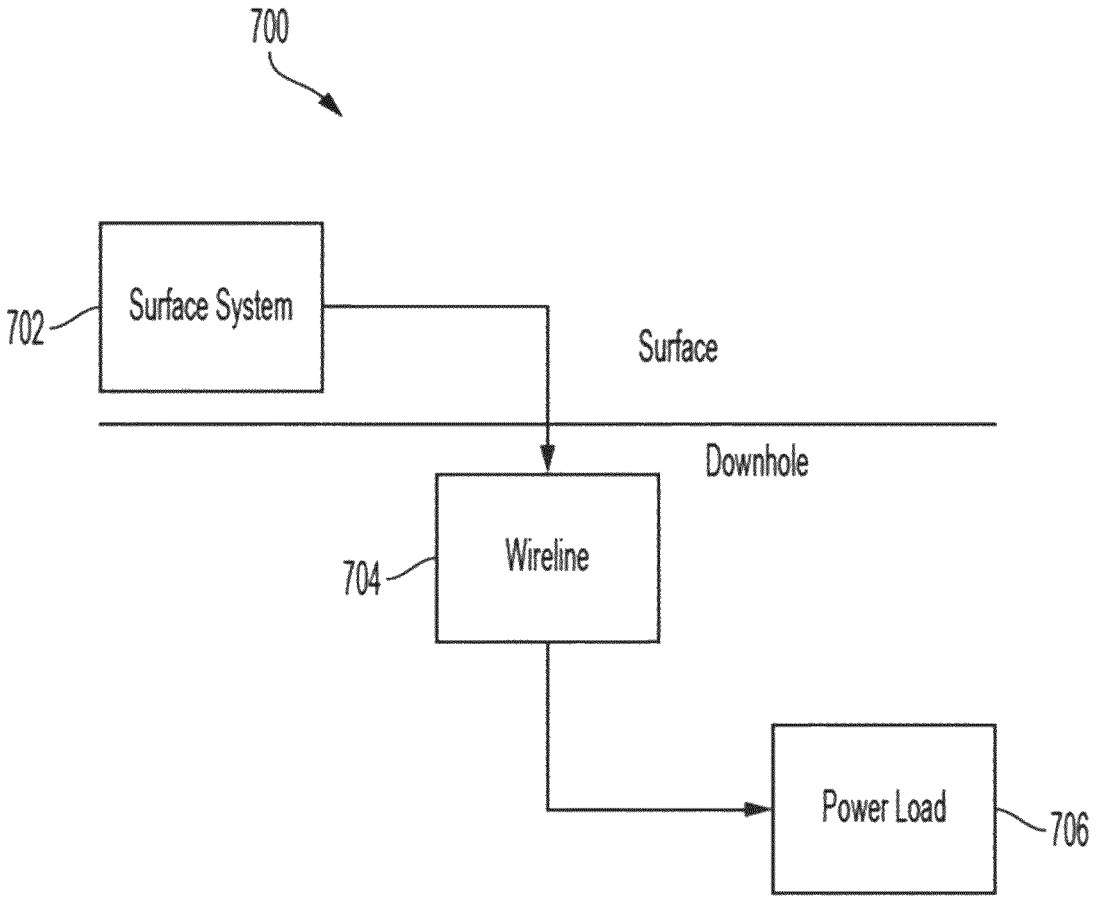
FIG. 7 illustrates a block diagram of an example well intervention system, according to some examples of the present disclosure.

FIG. 7 illustrates a block diagram of an example well intervention system 700. As shown in FIG. 7, well intervention system 700 can include at least a surface system 702, a wireline 704, and a power load 706. In some examples, power load 706 can include any known power converter and/or motor controller.

Figure 8:
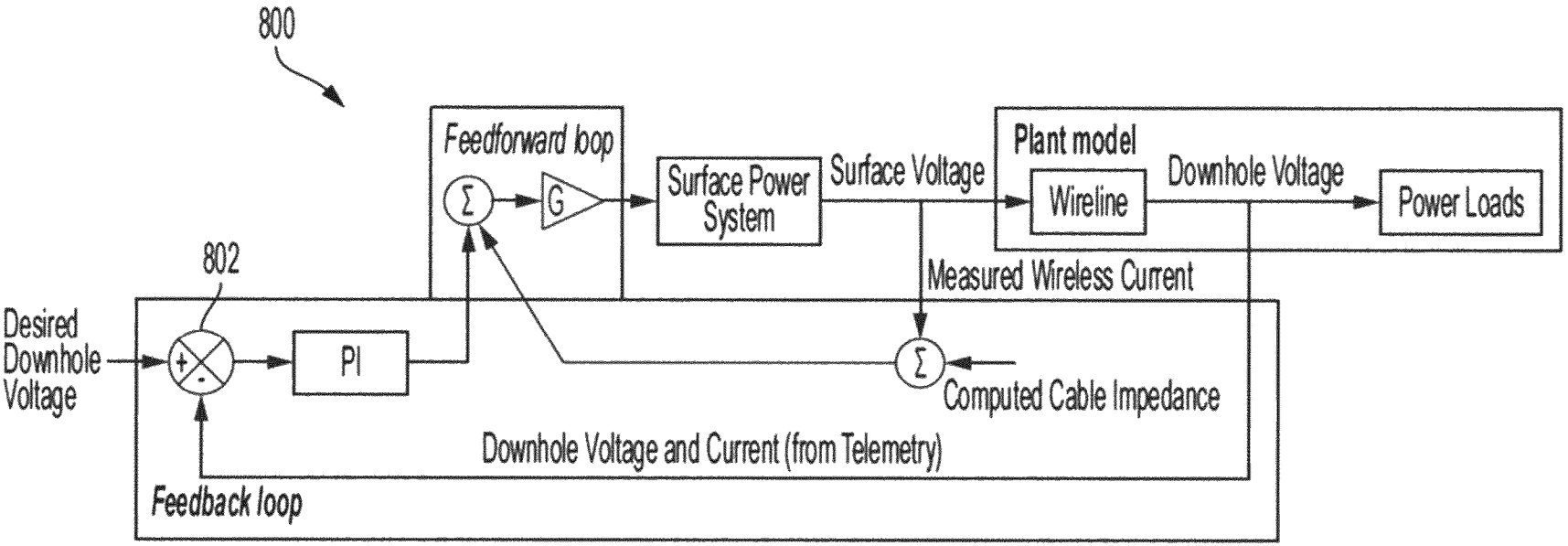
FIG. 8 illustrates an example downhole tool bus voltage control block diagram wherein the wireline is part of the plant model to be controlled, according to some examples of the present disclosure.

FIG. 8 illustrates an example downhole tool bus voltage control block diagram 800, wherein the wireline 704 is part of the plant model to be controlled. In one example, in order to determine the wireline parameters during runtime, the process can begin by injecting a signal into the wireline on the surface at component 802. For example, a cosine signal can be injected into the wireline on the surface by coupling a transformer or coupling a capacitor. The cosine signal generated on the surface can encompass several periods to provide sufficient computational resolution. This signal can step through several frequencies (i.e., 0.1 Hz to 10 Hz).

The downhole tool bus voltage control system 800 can also include one or more surface voltage and current sensors to measure the injected voltage and current. In some examples, the one or more surface voltage and current sensors can be located on the surface circuitry. The downhole tool bus voltage control system 800 can also include at least one downhole calibration resistor. In some examples, the downhole resistor can provide a bias current permitting current sensors to detect any variation in current on both the surface and the downhole nodes. The downhole tool bus voltage control system 800 can also include one or more downhole voltage and current sensors. In some examples, the downhole voltage and current sensors can measure both the downhole voltage and current when the cosine signal is generated on the surface. The downhole tool bus voltage control system 800 can also include telemetry communication. In some examples, telemetry communication can be used to facilitate sending the downhole measurement to the surface for computing the wireline parameters.

Described below is one example method of computing cable impedance. A cosine signal can be generated on the surface, and the voltage and current can both measured on the surface and downhole by the respective sensors. The cosine signal can span several periods (i.e., in some examples, 5 full cycles). Downhole processor can acquire both the voltage and current from the downhole sensors and compute their Fourier Transform. The phase offset between the voltage and current can be computed together with the amplitude. In some examples, these two parameters (i.e., real and imaginary values for the downhole voltage) can be sent to the surface using telemetry. The current phase can be used as a reference to determine the phase offset of the voltage.

Further, on the surface, similar process can occur. The surface processor can acquire both the voltage and current and compute their Fourier Transform. Similarly, the phase offset for the surface voltage can then be computed. The phase for the current can be used as reference. Subsequently, using both the downhole and surface voltage, the complex cable voltage drop can be computed and subsequently the impedance of the cable at the frequency can be computed. This process can be repeated for more than one frequency in order to obtain the low frequency pole and zero. Once the pole and zero are obtained, the cable parameter can be computed. As the cable unspools, this process keeps repeating and the cable parameters continue to update. For the first measurement, more frequency points can be needed to determine the low frequency pole and zero. However, subsequent computation can require less frequency points because the phase peaks can be already known in the original frequency, fc. Hence, a moving window can be placed over the fc and each computational process can then track the movement of this frequency, fc. Determination of fc for the first time can take longer as the algorithm can require sweeping through more frequency points in search of fc.

Figure 9:
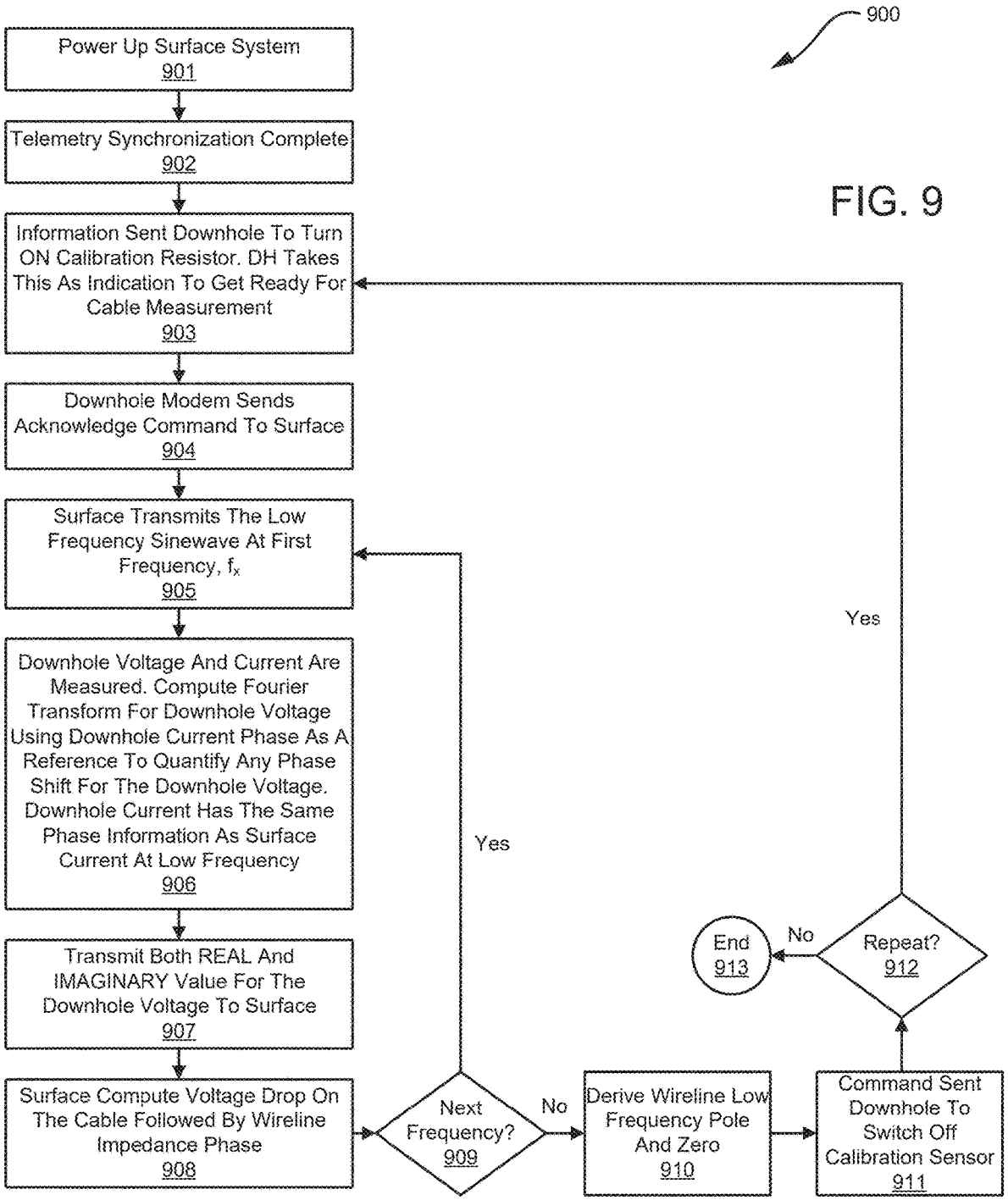
FIG. 9 illustrates an example computational flow diagram of the process for computing cable impedance, according to some examples of the present disclosure.

FIG. 9 illustrates an example computational flow diagram 900 of the process for computing cable impedance described above. At module 901, the process can include powering up the surface system. At module 902, the process can include completing telemetry synchronization. At module 903, the process can include sending information downhole to turn on the calibration resistor, which downhole can understand as an indication to prepare for cable measurement. At module 904, the process can include the downhole modem sending an acknowledge command to the surface. At module 905, the process can include transmitting the low frequency sinewave at the first frequency (i.e., fx) from the surface. At module 906, the process can include measuring the downhole voltage and current, computing a Fourier Transform for the downhole voltage using the downhole current phase as a reference to quantify any phase shift for the downhole voltage. In some examples, the downhole current can have the same phase information as the surface current at low frequencies. At module 907, the process can include transmitting both the real and imaginary values for the downhole voltage to the surface. At module 908, the process can include computing the voltage drop on the cable, followed by the wireline impedance phase, at the surface. At module 909, the process can include determining whether to transmit the next frequency. If the process at module 909 determines that it should transmit the next frequency, the process returns to module 905 wherein the process can include transmitting the low frequency sinewave at the next frequency from the surface. If the process at module 909 determines that it should not transmit the next frequency, the process continues to module 910 where the wireline low frequency pole and zero can be derived. Next, at module 911, the process can include sending a command downhole to switch off the calibration sensor. At module 912, the process can include determining whether to repeat the process. If the decision is made at module 912 to repeat the process, the process can return to module 903, which can include sending information downhole to turn on the calibration resistor. If the decision is made at module 912 to not repeat the process, the process can end (module 913).

In some examples, frequency fc can be determined using Equation 1.

$$F_C = \text{frequency at maximum phase, } \theta_C \qquad \text{Equation 1}$$

The low frequency pole can then be computed using Equation 2.

$$F_p = F_C * \tan\left(\frac{\theta_C}{2} + \frac{\pi}{2}\right) \qquad \text{Equation 2}$$

The low frequency zero can then be computed using Equation 3.

$$F_z = \frac{F_C}{\tan\left(\frac{\theta_C}{2} + \frac{\pi}{2}\right)} \qquad \text{Equation 3}$$

Now, the cable impedance can be computed through Equation 4.

$$Z_{cable} = R_C * \frac{1 + \frac{s}{2\pi * F_z}}{1 + \frac{s}{2\pi * F_p}}, \qquad \text{Equation 4}$$

where $R_C$ refers to the cable DC resistance which can subsequently be computed.

Figure 10:
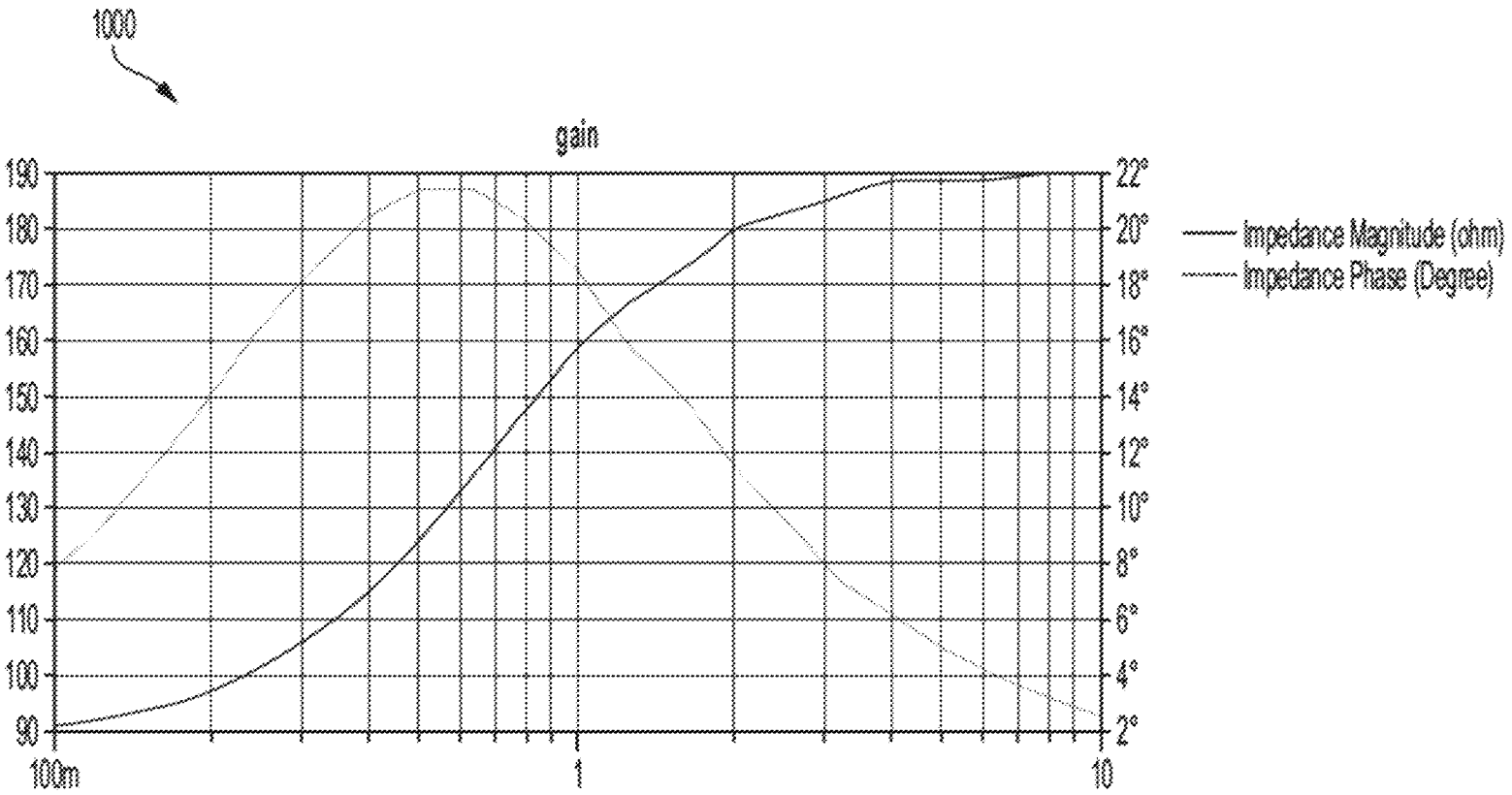
FIG. 10 illustrates an example simulated wireline impedance plot, according to some examples of the present disclosure.
Figure 11:
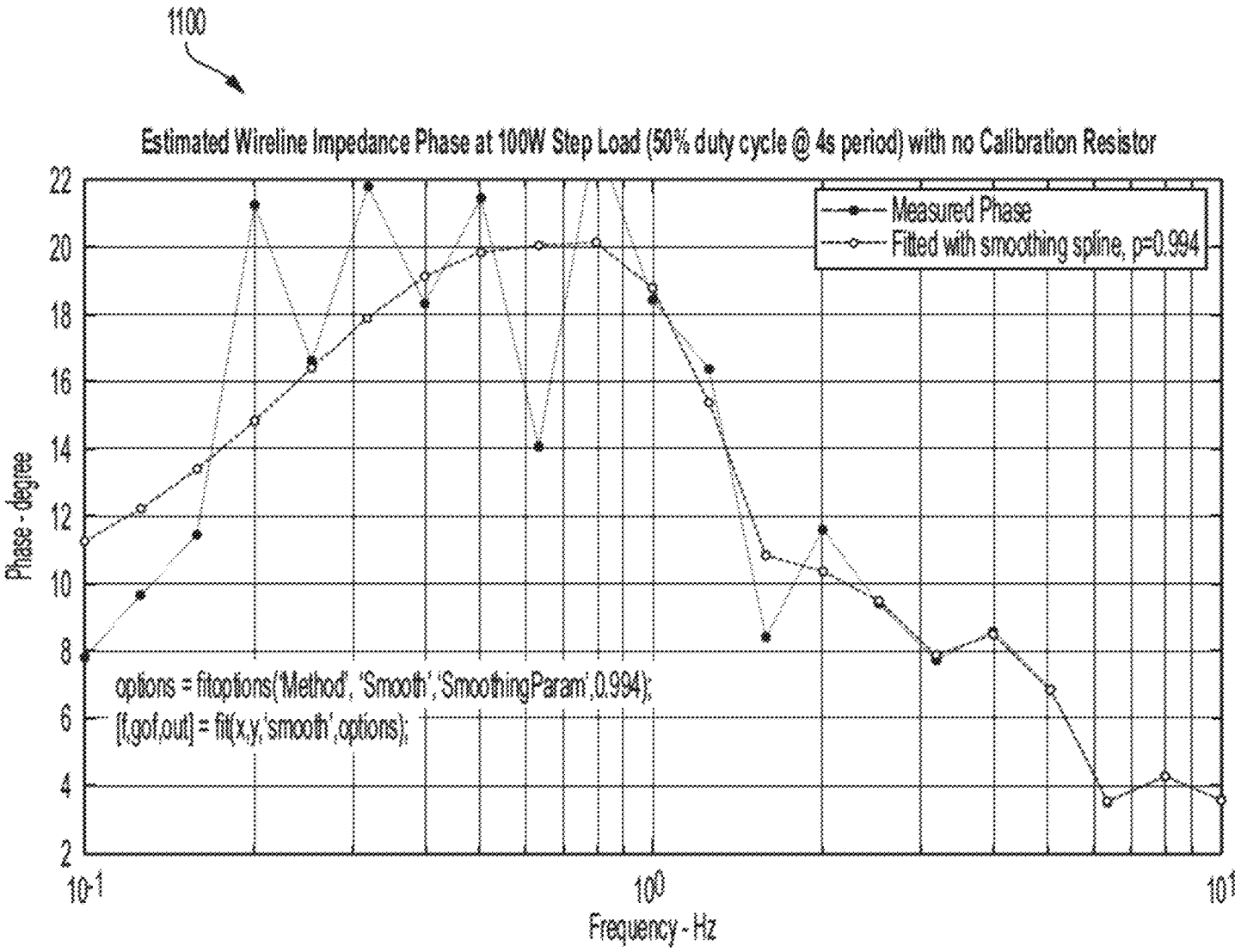
FIG. 11 illustrates a plot of wireline impedance that is measured and fitted, according to some examples of the present disclosure.

FIG. 10 illustrates an example simulated wireline impedance plot 1000 for both magnitude and phase with a downhole 100 W operational load and a 30002 downhole calibration resistor. The process can result in a clean impedance plot, where fc can be determined from the maximum phase. Subsequent steps can also be straight forward once fc is determined. FIG. 11 illustrates a plot 1100 of wireline impedance that is measured and fitted, according to some examples of the present disclosure. For example, a smoothing technique (such as smoothing spline, for example) may not restore the accuracy, but can minimize the inaccuracy drastically.

Figure 12:
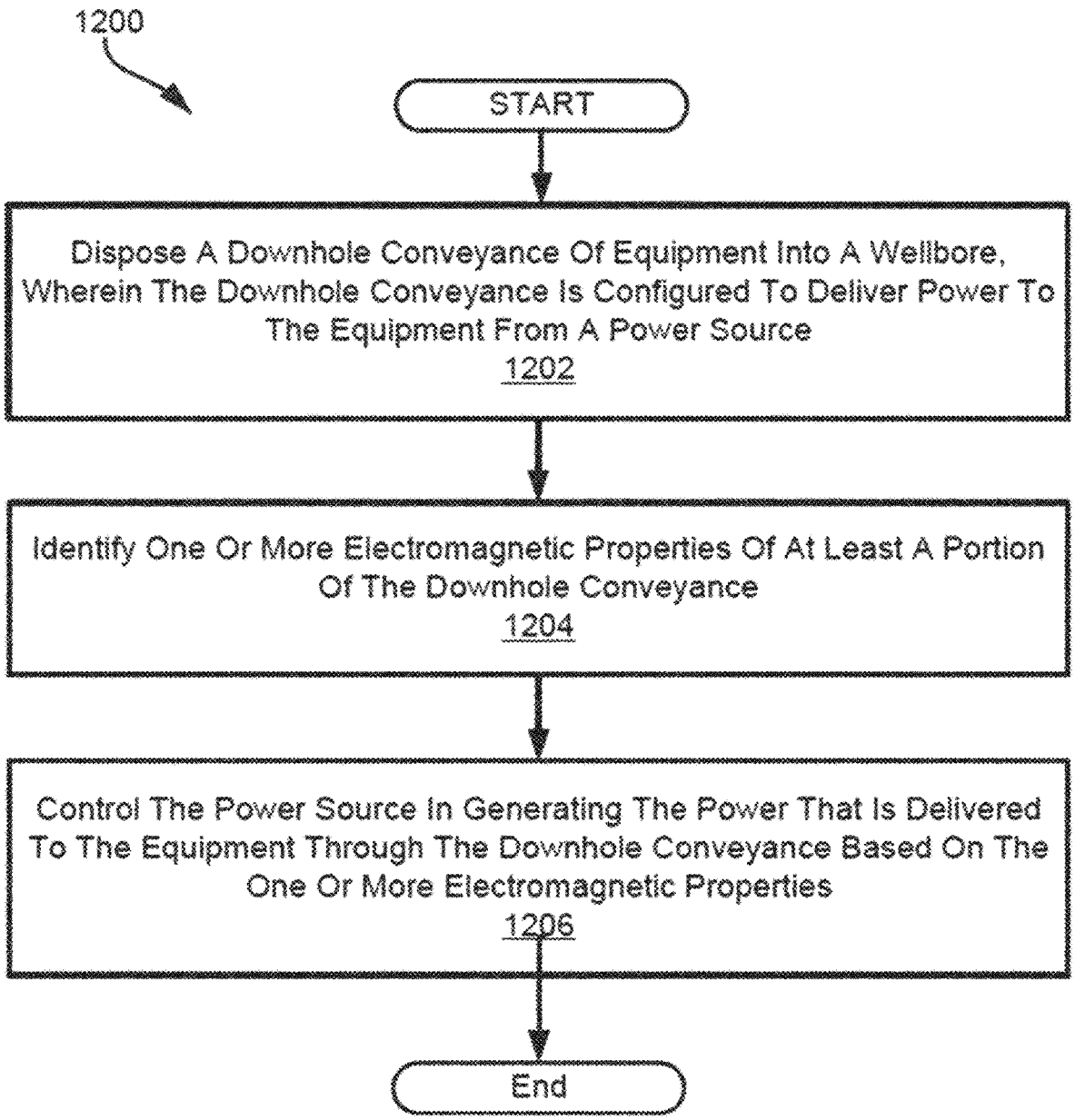
FIG. 12 illustrates a flowchart of an example method of controlling a power source for generating power to be delivered to equipment through a downhole conveyance based on one or more electromagnetic properties, according to some examples of the present disclosure.

FIG. 12 illustrates a flowchart 1200 of an example method of controlling a power source for generating power to be delivered to equipment through a downhole conveyance based on one or more electromagnetic properties, according to some examples of the present disclosure. The method shown in FIG. 12 is provided by way of example, as there are a variety of ways to carry out the method. Additionally, while the example method is illustrated with a particular order of steps, those of ordinary skill in the art will appreciate that FIG. 12 and the modules shown therein can be executed in any order and can include fewer or more modules than illustrated. Each module shown in FIG. 12 represents one or more steps, processes, methods or routines in the method. The modules will be discussed with respect to the example environments described herein.

At module 1202, equipment is disposed into a wellbore through a downhole conveyance. The downhole conveyance can be configured to deliver power to the equipment from a power source, e.g. a surface power source or a source in proximity to the surface. Specifically, in some examples, a downhole conveyance can include applicable oilfield conveyance and spooling mechanisms. For example, the downhole conveyance can include slickline, electric line (e-line), coiled tubing, coiled tubing remediation, coiled tubing evaluation operations, drilling operations, and any other related applications involving surface-to-downhole, surface-to-surface, and downhole-to-downhole data acquisition and conveyance methods.

As discussed above with reference to FIG. 1, wireline conveyance 154 can provide power and support for the tool, as well as enable communication between data processors 158A-N on the surface. In some examples, the wireline conveyance 154 can include electrical and/or fiber optic cabling for carrying out communications. The wireline conveyance 154 is sufficiently strong and flexible to tether the tool body 156 through the wellbore 151, while also permitting communication through the wireline conveyance 154 to one or more of the processors 158A-N, which can include local and/or remote processors. The processors 158A-N can be integrated as part of an applicable computing system, such as the computing device architectures described herein. Moreover, power can be supplied via the wireline conveyance 154 to meet power requirements of the tool. For slickline or coiled tubing configurations, power can be supplied downhole with a battery or via a downhole generator. Further, power can be supplied from the surface or near surface sources, e.g. through umbilicals.

At module 1204, identifying one or more electromagnetic properties of at least a portion of the downhole conveyance is performed. Specifically, the disclosed method can measure, compute and determine one or more applicable electromagnetic properties of the downhole conveyance, such as, for example, the impedance comprising both DC and AC components and in some cases cable capacitance. For example, three example components can include a downhole conveyance DC resistance (Rc), armor resistance (Ra), and inductance (L). Both the armor resistance 604 and inductance 606 can correspond to the AC component of the wireline impedance. Additionally, the armor resistance 604 can provide a discharge path for stored energy in the wireline to discharge through. In some examples, the DC component of the downhole conveyance can be determined during runtime and used as part of the plant model in the control loop. However, the lack of AC components can limit the control loop response time when responding to dynamic load changes at the downhole end of the wireline.

The downhole conveyance can be a wireline. A wireline cable can comprise a conductor at the center that wrapped with an insulating material. The wirelines cable can also comprise an armor that is wrapped around the insulating material. The armor can be a conductor. Current can flow from the center conductor and back through the armor. In various embodiments, another insulating material that is wrapped around the armor. Physical dimension of the wireline contribute to the cable characteristics. For example, cable length, conductor material (e.g. copper) and conductor cross section area can affect the resistance (the DC characteristic). Thickness of the insulating material between the conductor and the armor and the type of material of this insulator can affect the capacitance and inductance. Length of conductor and whether the cable is wound over a metal or wooden drum can affect the inductance of the cable. All these physical properties can affect or define the electrical characteristics, which can be measured in the form of resistance, inductance and capacitance. The resistance, inductance and capacitance can be lumped together and affect the impedance at various frequencies.

In one example, in order to determine the downhole conveyance parameters during runtime, the process can begin by injecting a signal into the downhole conveyance on the surface. For example, a cosine signal can be injected into the downhole conveyance on the surface by coupling a transformer or coupling a capacitor. The cosine signal generated on the surface can encompass several periods to provide sufficient computational resolution. This signal can step through several frequencies (i.e., 0.1 Hz to 10 Hz) in order to identify electromagnetic properties of the downhole conveyance while in operation to dispose equipment downhole.

At module 1206, the power source is controlled in generating the power that is delivered to the equipment through the downhole conveyance based on the one or more electromagnetic properties. Specifically, while the downhole conveyance impedance can be determined in runtime, those parameters can be used to set and regulate the downhole tool bus voltage. The ability to determine the downhole conveyance impedance parameters in runtime without powering off the downhole tools can be advantageous for tool operations because the downhole conveyance parameters can be continuously updated as the tool is deployed into the borehole. Furthermore, the proposed method can be used in system where the downhole bus voltage is regulated by the surface system or by a downhole DCDC converter. This can facilitate and improve the control accuracy and response time when regulating the downhole tool bus voltage for varying loads.

In some scenarios, as the downhole tool is deployed, the downhole conveyance can continue to unspool, which can cause the cable impedance to change. The downhole bus voltage can be either controlled by the surface system to maintain regulation or include a downhole DCDC converter to perform regulation. The disclosed method can be used in either scenario. For example, in the scenario where the downhole bus voltage is controlled by the surface system, the surface voltage can change dynamically in response to the downhole load in order to maintain regulation for downhole bus voltage. In some examples, controlling the downhole bus voltage by the surface system can include controlling the power source in generating the power that is delivered to the equipment through the downhole conveyance based on the one or more electromagnetic properties.

In some examples, a controller can apply a machine learning (ML) model and/or artificial intelligence to the determined electromagnetic property data to control the power source in generating the power that is delivered to the equipment through the downhole conveyance. For example, an ML model can be applied to identifying the downhole bus voltage and ultimately control the downhole bus voltage, e.g. by controlling the power source in generating the power that is delivered to the equipment through the downhole conveyance based on the electromagnetic properties. Specifically, the controller can apply a selection model that is trained through artificial intelligence and machine learning to the electromagnetic property data to select a power source control plan to select the correct downhole bus voltages during runtime. For example, the controller can measure, compute and determine one or more electromagnetic properties of the downhole conveyance, such as, for example, the impedance comprising both DC and AC components and can apply a power source control plan.

An applicable type of ML model can be trained and used in controlling power delivery operations through a downhole conveyance. It is contemplated that the machine learning and/or artificial intelligence models can be applied during runtime, or used in any future operations to control power delivery through a downhole conveyance. Specifically, a trained ML model can be applied to control downhole power delivery through the same conveyance that was used in training the ML model, a different type of downhole conveyance that was used in training the ML model, or a same type of downhole conveyance that was used in training the ML model.

Figure 13:
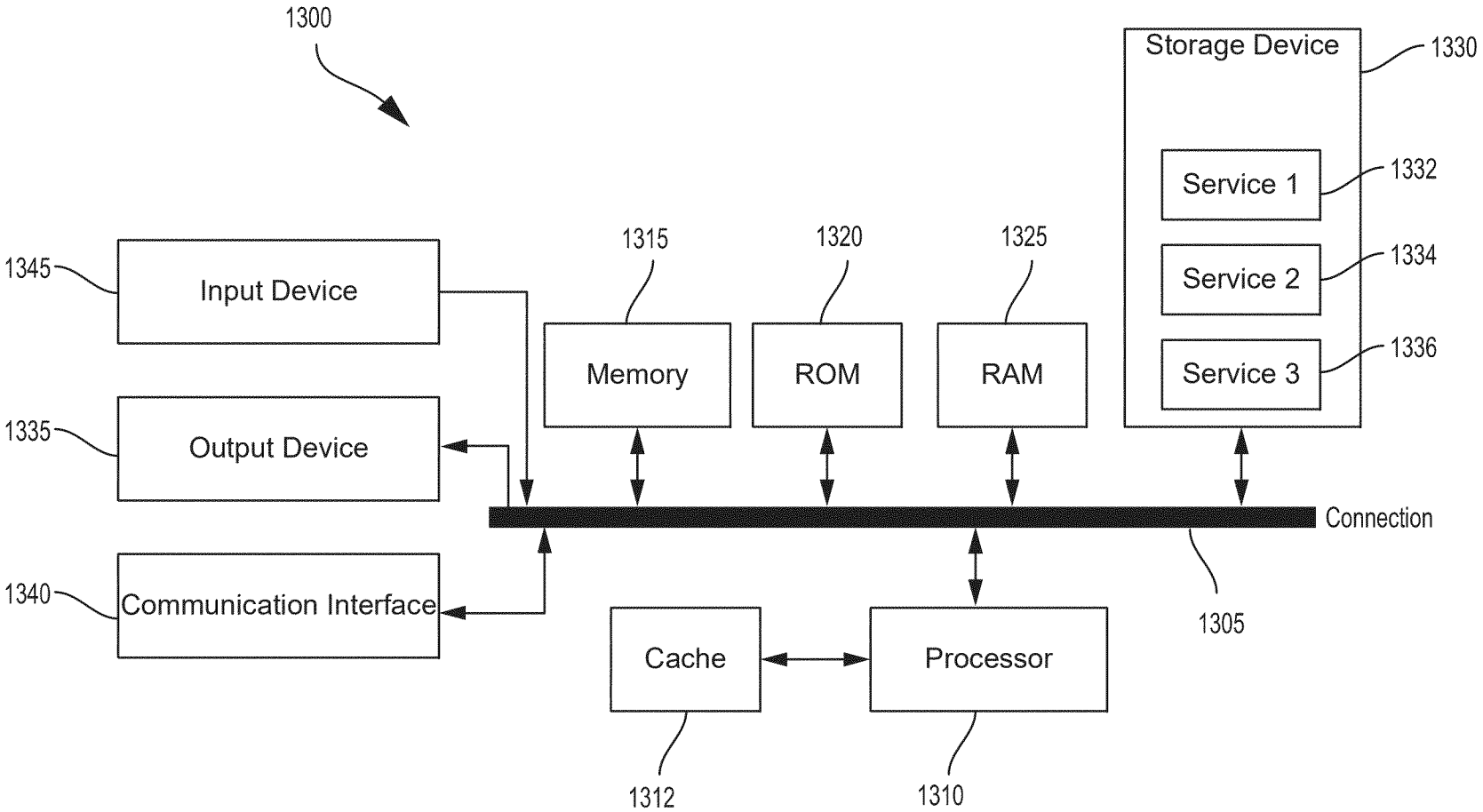
FIG. 13 illustrates an example processor-based system with which some aspects of the subject technology can be implemented, according to some examples of the present disclosure.

FIG. 13 illustrates an example processor-based system with which some aspects of the subject technology can be implemented. For example, processor-based system 1300 can be any computing device, or any component thereof, in which the components of the system are in communication with each other using connection 1305. Connection 1305 can be a physical connection via a bus, or a direct connection into processor 1310, such as in a chipset architecture. Connection 1305 can also be a virtual connection, networked connection, or logical connection.

In some embodiments, computing system 1300 is a distributed system in which the functions described in this disclosure can be distributed within a datacenter, multiple data centers, a peer network, etc. In some embodiments, one or more of the described system components represents many such components each performing some or all of the function for which the component is described. In some embodiments, the components can be physical or virtual devices.

Example system 1300 includes at least one processing unit (Central Processing Unit (CPU) or processor) 1310 and connection 1305 that couples various system components including system memory 1315, such as Read-Only Memory (ROM) 1320 and Random-Access Memory (RAM) 1325 to processor 1310. Computing system 1300 can include a cache of high-speed memory 1312 connected directly with, in close proximity to, or integrated as part of processor 1310.

Processor 1310 can include any general-purpose processor and a hardware service or software service, such as services 1332, 1334, and 1336 stored in storage device 1330, configured to control processor 1310 as well as a special-purpose processor where software instructions are incorporated into the actual processor design. Processor 1310 may essentially be a completely self-contained computing system, containing multiple cores or processors, a bus, memory controller, cache, etc. A multi-core processor may be symmetric or asymmetric.

To enable user interaction, computing system 1300 includes an input device 1345, which can represent any number of input mechanisms, such as a microphone for speech, a touch-sensitive screen for gesture or graphical input, keyboard, mouse, motion input, speech, etc. Computing system 1300 can also include output device 1335, which can be one or more of a number of output mechanisms known to those of skill in the art. In some instances, multimodal systems can enable a user to provide multiple types of input/output to communicate with computing system 1300. Computing system 1300 can include communications interface 1340, which can generally govern and manage the user input and system output. The communication interface may perform or facilitate receipt and/or transmission wired or wireless communications via wired and/or wireless transceivers, including those making use of an audio jack/plug, a microphone jack/plug, a Universal Serial Bus (USB) port/plug, an Apple® Lightning® port/plug, an Ethernet port/plug, a fiber optic port/plug, a proprietary wired port/plug, a BLUETOOTH® wireless signal transfer, a BLUETOOTH® low energy (BLE) wireless signal transfer, an IBEACON® wireless signal transfer, a Radio-Frequency Identification (RFID) wireless signal transfer, Near-Field Communications (NFC) wireless signal transfer, Dedicated Short Range Communication (DSRC) wireless signal transfer, 802.11 Wi-Fi® wireless signal transfer, Wireless Local Area Network (WLAN) signal transfer, Visible Light Communication (VLC) signal transfer, Worldwide Interoperability for Microwave Access (WiMAX), Infrared (IR) communication wireless signal transfer, Public Switched Telephone Network (PSTN) signal transfer, Integrated Services Digital Network (ISDN) signal transfer, 3G/4G/5G/LTE cellular data network wireless signal transfer, ad-hoc network signal transfer, radio wave signal transfer, microwave signal transfer, infrared signal transfer, visible light signal transfer signal transfer, ultraviolet light signal transfer, wireless signal transfer along the electromagnetic spectrum, or some combination thereof.

Communication interface 1340 may also include one or more Global Navigation Satellite System (GNSS) receivers or transceivers that are used to determine a location of the computing system 1300 based on receipt of one or more signals from one or more satellites associated with one or more GNSS systems. GNSS systems include, but are not limited to, the US-based Global Positioning System (GPS), the Russia-based Global Navigation Satellite System (GLONASS), the China-based BeiDou Navigation Satellite System (BDS), and the Europe-based Galileo GNSS. There is no restriction on operating on any particular hardware arrangement, and therefore the basic features here may easily be substituted for improved hardware or firmware arrangements as they are developed.

Storage device 1330 can be a non-volatile and/or non-transitory and/or computer-readable memory device and can be a hard disk or other types of computer readable media which can store data that are accessible by a computer, such as magnetic cassettes, flash memory cards, solid state memory devices, digital versatile disks, cartridges, a floppy disk, a flexible disk, a hard disk, magnetic tape, a magnetic strip/stripe, any other magnetic storage medium, flash memory, memristor memory, any other solid-state memory, a Compact Disc (CD) Read Only Memory (CD-ROM) optical disc, a rewritable CD optical disc, a Digital Video Disk (DVD) optical disc, a Blu-ray Disc (BD) optical disc, a holographic optical disk, another optical medium, a Secure Digital (SD) card, a micro SD (microSD) card, a Memory Stick® card, a smartcard chip, a EMV chip, a Subscriber Identity Module (SIM) card, a mini/micro/nano/pico SIM card, another Integrated Circuit (IC) chip/card, Random-Access Memory (RAM), Atatic RAM (SRAM), Dynamic RAM (DRAM), Read-Only Memory (ROM), Programmable ROM (PROM), Erasable PROM (EPROM), Electrically Erasable PROM (EEPROM), flash EPROM (FLASHEPROM), cache memory (L1/L2/L3/L4/L5/L #), Resistive RAM (RRAM/ReRAM), Phase Change Memory (PCM), Spin Transfer Torque RAM (STT-RAM), another memory chip or cartridge, and/or a combination thereof.

Storage device 1330 can include software services, servers, services, etc., that when the code that defines such software is executed by the processor 1310, it causes the system 1300 to perform a function. In some embodiments, a hardware service that performs a particular function can include the software component stored in a computer-readable medium in connection with the necessary hardware components, such as processor 1310, connection 1305, output device 1335, etc., to carry out the function.

Figure 14:
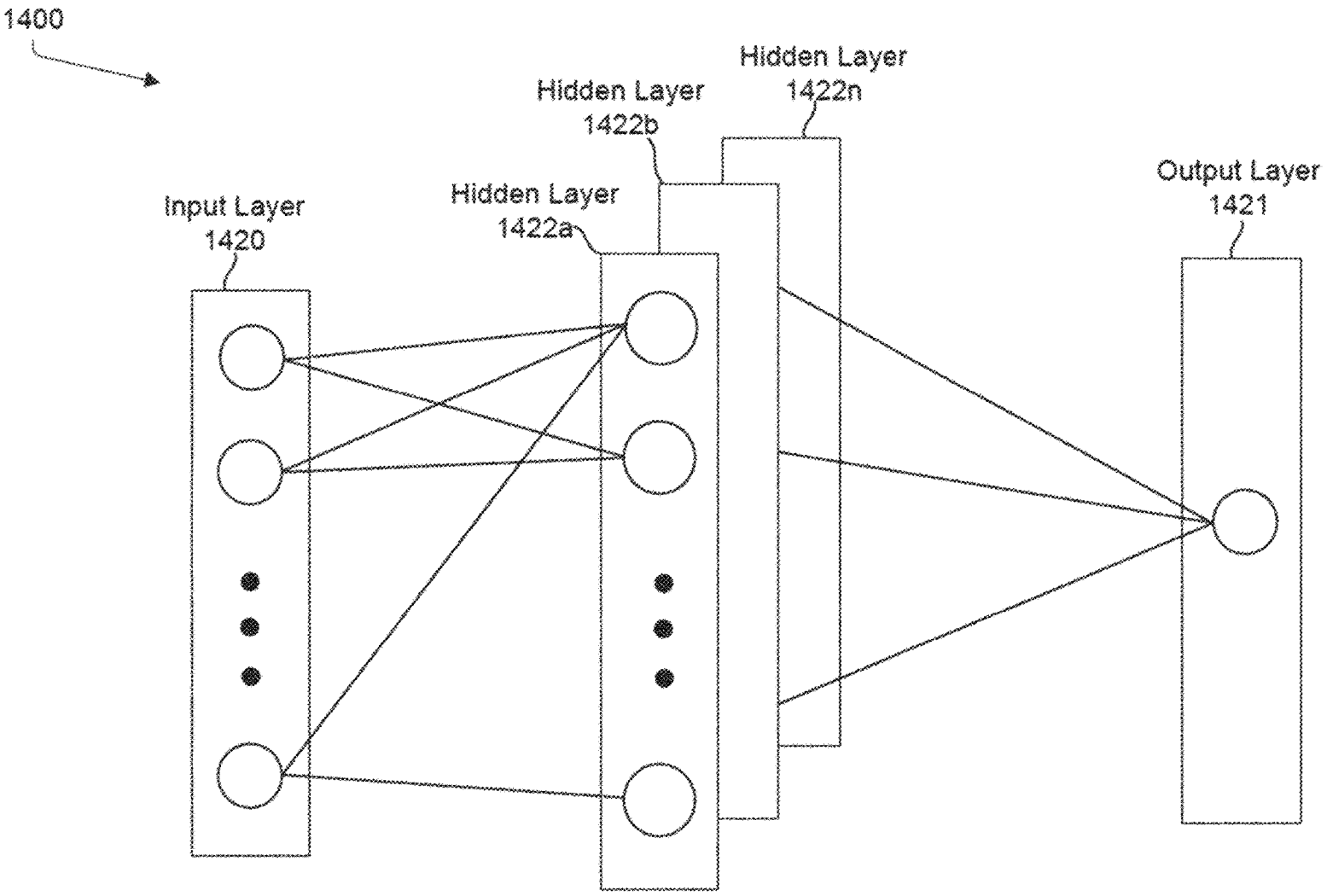
FIG. 14 is an example of a deep learning neural network that can be used to implement all or a portion of the systems and techniques described herein, according to some examples of the present disclosure.

In FIG. 14, the disclosure now turns to a further discussion of a model that can be used to implement the technology described herein. FIG. 14 is an example of a deep learning neural network 1400 that can be used to implement all or a portion of the systems and techniques described herein, according to some examples of the present disclosure. An input layer 1420 can be configured to receive data. Neural network 1400 includes multiple hidden layers 1422*a*, 1422*b*, through 1422*n*. The hidden layers 1422*a*, 1422*b*, through 1422*n* include "n" number of hidden layers, where "n" is an integer greater than or equal to one. The number of hidden layers can be made to include as many layers as needed for the given application. Neural network 1400 further includes an output layer 1421 that provides an output resulting from the processing performed by the hidden layers 1422*a*, 1422*b*, through 1422*n*.

Neural network 1400 is a multi-layer neural network of interconnected nodes. Each node can represent a piece of information. Information associated with the nodes is shared among the different layers and each layer retains information as information is processed. In some cases, the neural network 1400 can include a feed-forward network, in which case there are no feedback connections where outputs of the network are fed back into itself. In some cases, the neural network 1400 can include a recurrent neural network, which can have loops that allow information to be carried across nodes while reading in input.

Information can be exchanged between nodes through node-to-node interconnections between the various layers. Nodes of the input layer 1420 can activate a set of nodes in the first hidden layer 1422*a*. For example, as shown, each of the input nodes of the input layer 1420 is connected to each of the nodes of the first hidden layer 1422*a*. The nodes of the first hidden layer 1422*a* can transform the information of each input node by applying activation functions to the input node information. The information derived from the transformation can then be passed to and can activate the nodes of the next hidden layer 1422*b*, which can perform their own designated functions. Example functions include convolutional, up-sampling, data transformation, and/or any other suitable functions. The output of the hidden layer 1422*b* can then activate nodes of the next hidden layer, and so on. The output of the last hidden layer 1422*n* can activate one or more nodes of the output layer 1421, at which an output is provided. In some cases, while nodes in the neural network 1400 are shown as having multiple output lines, a node can have a single output and all lines shown as being output from a node represent the same output value.

In some cases, each node or interconnection between nodes can have a weight that is a set of parameters derived from the training of the neural network 1400. Once the neural network 1400 is trained, it can be referred to as a trained neural network, which can be used to classify one or more activities. For example, an interconnection between nodes can represent a piece of information learned about the interconnected nodes. The interconnection can have a tunable numeric weight that can be tuned (e.g., based on a training dataset), allowing the neural network 1400 to be adaptive to inputs and able to learn as more and more data is processed.

The neural network 1400 is pre-trained to process the features from the data in the input layer 1420 using the different hidden layers 1422*a*, 1422*b*, through 1422*n* in order to provide the output through the output layer 1421.

In some cases, the neural network 1400 can adjust the weights of the nodes using a training process called backpropagation. A backpropagation process can include a forward pass, a loss function, a backward pass, and a weight update. The forward pass, loss function, backward pass, and parameter/weight update is performed for one training iteration. The process can be repeated for a certain number of iterations for each set of training data until the neural network 1400 is trained well enough so that the weights of the layers are accurately tuned.

To perform training, a loss function can be used to analyze error in the output. Any suitable loss function definition can be used, such as a Cross-Entropy loss. Another example of a loss function includes the mean squared error (MSE), defined as E_total=Σ(1/2 (target-output)^2). The loss can be set to be equal to the value of E_total.

The loss (or error) will be high for the initial training data since the actual values/training output will be much different than the predicted output. The goal of training is to minimize the amount of loss so that the predicted output is the same as the training output. The neural network 1400 can perform a backward pass by determining which inputs (weights) most contributed to the loss of the network, and can adjust the weights so that the loss decreases and is eventually minimized.

The neural network 1400 can include any suitable deep network. One example includes a Convolutional Neural Network (CNN), which includes an input layer and an output layer, with multiple hidden layers between the input and out layers. The hidden layers of a CNN include a series of convolutional, nonlinear, pooling (for downsampling), and fully connected layers. The neural network 1400 can include any other deep network other than a CNN, such as an autoencoder, Deep Belief Nets (DBNs), Recurrent Neural Networks (RNNs), among others.

As understood by those of skill in the art, machine-learning based classification techniques can vary depending on the desired implementation. For example, machine-learning classification schemes can utilize one or more of the following, alone or in combination: hidden Markov models; RNNs; CNNs; deep learning; Bayesian symbolic methods; Generative Adversarial Networks (GANs); support vector machines; image registration methods; and applicable rule-based systems. Where regression algorithms are used, they may include but are not limited to: a Stochastic Gradient Descent Regressor, a Passive Aggressive Regressor, etc.

Machine learning classification models can also be based on clustering algorithms (e.g., a Mini-batch K-means clustering algorithm), a recommendation algorithm (e.g., a Min-wise Hashing algorithm, or Euclidean Locality-Sensitive Hashing (LSH) algorithm), and/or an anomaly detection algorithm, such as a local outlier factor. Additionally, machine-learning models can employ a dimensionality reduction approach, such as, one or more of: a Mini-batch Dictionary Learning algorithm, an incremental Principal Component Analysis (PCA) algorithm, a Latent Dirichlet Allocation algorithm, and/or a Mini-batch K-means algorithm, etc.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Selected Examples

Illustrative examples of the disclosure include:

Aspect 1. A computer-implemented method comprising: performing a spooling operation of displacing line relative to a hole in a downhole environment, the line spooling operation comprising either or both a running in the hole (RIH) operation and a pulling out of the hole (POOH) operation; identifying information related to the line during the spooling operation as a function of wrap number relative to a drum that spools the line during either or both the RIH operation and the POOH operation; and facilitating control of the line during the spooling operation based on the information.

Aspect 2. The computer-implemented method of Aspect 1, wherein the information comprises a depth of the line in the hole as a function of a layer number of the line around the drum, a tension of the line as a function of wrap number of the line around the drum, or a combination thereof.

Aspect 3. The computer-implemented method of either of Aspects 1 or 2, wherein the information is a function of both the wrap number relative to the drum and a layer number of the line spooled around the drum.

Aspect 4. The computer-implemented method of any of Aspects 1 through 3, further comprising: identifying a drum diameter of the drum, a flange diameter of a flange of the drum, a line diameter, a radius of the drum with the line spooled around the drum, a start position of the line relative to being spooled around the drum, a stop position relative to the line being spooled around the drum, a wrap number of the line spooled around the drum, a layer number of the line spooled around the drum, a distance to line, a revolution per minute of the drum during the spooling operation, a position of the drum, or a combination thereof; identifying the information relation to the line during the spooling operation based on the drum diameter of the drum, the flange diameter of the flange of the drum, the line diameter, the radius of the drum with the line spooled around the drum, the start position of the line relative to being spooled around the drum, the stop position relative to the line being spooled around the drum, the wrap number of the line spooled around the drum, the layer number of the line spooled around the drum, the distance to line, the revolution per minute of the drum during the spooling operation, the position of the drum, or the combination thereof.

Aspect 5. The computer-implemented method of any of Aspects 1 through 4, further comprising autonomously controlling the spooling operation based on the information.

Aspect 6. The computer-implemented method of any of Aspects 1 through 5, further comprising: generating a graphical representation of the information; presenting the graphical representation of the information to an operator for controlling the spooling operation based on the information.

Aspect 7. The computer-implemented method of Aspect 6, wherein the graphical representation comprises tension measurements of the line during the spooling operation at corresponding wrap locations in corresponding layers of the line spooled around the drum.

Aspect 8. The computer-implemented method of any of Aspects 1 through 7, wherein facilitating control of the spooling operation further comprises facilitating performance of one or more remedial measures with respect to the line being improperly spooled around the drum based on the information.

Aspect 9. The computer-implemented method of any of Aspects 1 through 8, further comprising: generating a model of based on the information; and facilitating control of one or more subsequent spooling operations based on the model.

Aspect 10. The computer-implemented method of Aspect 9, further comprising: predicting an event during a subsequent spooling operation based on the model; and facilitating control of the subsequent spooling operation based on the predicted event.

Aspect 11. The computer-implemented method of Aspect 9, further comprising: accessing a plan of a subsequent spooling operation using the line spooled around the drum; performing a risk assessment with respect to equipment for performing the spooling operation based on the model; and facilitating performance of the subsequent spooling operation based on the risk assessment Aspect 12. The computer-implemented method of any of Aspects 1 through 11, wherein the information related to the line during operation of the spooling operation comprises predictive indicators of a probability of failure a system for performing the spooling operation, system wear of the system, degradation status of the system, remaining operational lifetime of the system, or a combination thereof.

Aspect 13. The computer-implemented method of any of Aspects 1 through 12, further comprising: accessing environmental parameters of the downhole environment; and identifying the information related to the line during the spooling operation based on the environmental parameters.

Aspect 14. The computer-implemented method of Aspect 13, wherein the environmental parameters comprise a downhole tension of the line, a downhole temperature, a downhole pressure, a weight of downhole equipment, or a combination thereof.

Aspect 15. The computer-implemented method of any of Aspects 1 through 14, further comprising: generating a maintenance plan for a system for performing the spooling operation comprising the drum based on the information; and facilitating implementation of the maintenance plan.

Aspect 16. The computer-implemented method of any of Aspects 1 through 15, wherein the line is a wire that is moved in the hole during a wireline operation.

Aspect 17. A system comprising: one or more processors; and at least one computer-readable storage medium having stored therein instructions which, when executed by the one or more processors, cause the one or more processors to: perform a spooling operation of displacing line relative to a hole in a downhole environment, the line spooling operation comprising either or both a running in the hole (RIH) operation and a pulling out of the hole (POOH) operation; identify information related to the line during the spooling operation as a function of wrap number relative to a drum that spools the line during either or both the RIH operation and the POOH operation; and facilitate control of the line during the spooling operation based on the information.

Aspect 18. The system of Aspect 17, wherein the instructions further cause the one or more processors to: generate a model of based on the information; and facilitate control of one or more subsequent spooling operations based on the model.

Aspect 19. The system of Aspect 17, wherein the instructions further cause the one or more processors to autonomously control the spooling operation based on the information.

Aspect 20. A non-transitory computer-readable storage medium storing instructions for causing one or more processors to: perform a spooling operation of displacing line relative to a hole in a downhole environment, the line spooling operation comprising either or both a running in the hole (RIH) operation and a pulling out of the hole (POOH) operation; identify information related to the line during the spooling operation as a function of wrap number relative to a drum that spools the line during either or both the RIH operation and the POOH operation; and facilitate control of the line during the spooling operation based on the information.

Aspect 21. A system comprising means for performing a method according to any of Aspects 1 to 16.

What is claimed is:

1. A computer-implemented method comprising:

performing a spooling operation of displacing line relative to a hole in a downhole environment, the line spooling operation comprising either or both a running in the hole (RIH) operation and a pulling out of the hole (POOH) operation;

identifying information related to the line during the spooling operation during either or both the RIH operation and the POOH operation, wherein the information comprises a depth of the line in the hole as a function of a layer of the line around the drum, a tension of the line as a function of wrap number of the line relative to the drum, or a combination thereof; and controlling displacement of the line during the spooling operation based on the information.

2. The computer-implemented method of claim 1, wherein the information is a function of both the wrap number relative to the drum and a layer number of the line spooled around the drum.

3. The computer-implemented method of claim 1, further comprising:

identifying a drum diameter of the drum, a flange diameter of a flange of the drum, a line diameter, a radius of the drum with the line spooled around the drum, a start position of the line relative to being spooled around the drum, a stop position relative to the line being spooled around the drum, a wrap number of the line spooled around the drum, a layer number of the line spooled around the drum, a distance to line, a revolution per minute of the drum during the spooling operation, a position of the drum, or a combination thereof;

identifying the information relation to the line during the spooling operation based on the drum diameter of the drum, the flange diameter of the flange of the drum, the line diameter, the radius of the drum with the line spooled around the drum, the start position of the line relative to being spooled around the drum, the stop position relative to the line being spooled around the drum, the wrap number of the line spooled around the drum, the layer number of the line spooled around the drum, the distance to line, the revolution per minute of the drum during the spooling operation, the position of the drum, or the combination thereof.

4. The computer-implemented method of claim 1, further comprising autonomously controlling the spooling operation based on the information.

5. The computer-implemented method of claim 1, further comprising:

generating a graphical representation of the information;

presenting the graphical representation of the information to an operator with guidelines on controlling the spooling operation based on the information.

6. The computer-implemented method of claim 5, wherein the graphical representation comprises tension measurements of the line during the spooling operation at corresponding wrap locations in corresponding layers of the line spooled around the drum.

7. The computer-implemented method of claim 1, wherein facilitating control of the spooling operation further comprises facilitating performance of one or more remedial measures with respect to the line being improperly spooled around the drum based on the information.

8. The computer-implemented method of claim 1, further comprising:

generating a model of based on the information; and facilitating control of one or more subsequent spooling operations based on the model.

9. The computer-implemented method of claim 8, further comprising:

predicting an event during a subsequent spooling operation based on the model; and facilitating control of the subsequent spooling operation based on the predicted event.

10. The computer-implemented method of claim 8, further comprising:

accessing a plan of a subsequent spooling operation using the line spooled around the drum;

performing a risk assessment with respect to equipment for performing the spooling operation based on the model; and facilitating performance of the subsequent spooling operation based on the risk assessment.

11. The computer-implemented method of claim 1, wherein the information related to the line during operation of the spooling operation comprises predictive indicators of a probability of failure a system for performing the spooling operation, system wear of the system, degradation status of the system, remaining operational lifetime of the system, or a combination thereof.

12. The computer-implemented method of claim 1, further comprising:

accessing environmental parameters of the downhole environment; and identifying the information related to the line during the spooling operation based on the environmental parameters.

13. The computer-implemented method of claim 12, wherein the environmental parameters comprise a downhole tension of the line, a downhole temperature, a downhole pressure, a weight of downhole equipment, or a combination thereof.

14. The computer-implemented method of claim 1, further comprising:

generating a maintenance plan for a system for performing the spooling operation comprising the drum based on the information; and facilitating implementation of the maintenance plan.

15. The computer-implemented method of claim 1, wherein the line is a wire that is moved in the hole during a wireline operation.

16. A system comprising:

one or more processors; and at least one computer-readable storage medium having stored therein instructions which, when executed by the one or more processors, cause the one or more processors to:

perform a spooling operation of displacing line relative to a hole in a downhole environment, the line spooling operation comprising either or both a running in the hole (RIH) operation and a pulling out of the hole (POOH) operation;

identify information related to the line during the spooling operation during either or both the RIH operation and the POOH operation, wherein the information comprises a depth of the line in the hole as a function of a layer of the line around the drum, a tension of the line as a function of wrap number of the line relative to the drum, or a combination thereof; and controlling displacement of the line during the spooling operation based on the information.

17. The system of claim 16, wherein the instructions further cause the one or more processors to:

generate a model of based on the information; and facilitate control of one or more subsequent spooling operations based on the model.

18. The system of claim 16, wherein the instructions further cause the one or more processors to autonomously control the spooling operation based on the information.

19. A non-transitory computer-readable storage medium storing instructions for causing one or more processors to:

perform a spooling operation of displacing line relative to a hole in a downhole environment, the line spooling operation comprising either or both a running in the hole (RIH) operation and a pulling out of the hole (POOH) operation;

identify information related to the line during the spooling operation during either or both the RIH operation and the POOH operation, wherein the information comprises a depth of the line in the hole as a function of a layer of the line around the drum, a tension of the line as a function of wrap number of the line relative to the drum, or a combination thereof; and controlling displacement of the line during the spooling operation based on the information.

* * * * *